US012384647B2

(12) United States Patent
Shibasaki et al.

(10) Patent No.: US 12,384,647 B2
(45) Date of Patent: Aug. 12, 2025

(54) SHEET FOLDING APPARATUS, IMAGE FORMING APPARATUS, AND IMAGE FORMING SYSTEM

(71) Applicants: Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Tokyo (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(72) Inventors: Yuusuke Shibasaki, Tokyo (JP); Yusuke Hirono, Kanagawa (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Tokyo (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 117 days.

(21) Appl. No.: 18/528,801

(22) Filed: Dec. 5, 2023

(65) Prior Publication Data

US 2024/0182258 A1 Jun. 6, 2024

(30) Foreign Application Priority Data

Dec. 6, 2022 (JP) ..... 2022-195096

(51) Int. Cl.
*B65H 45/16* (2006.01)

(52) U.S. Cl.
CPC ..... *B65H 45/16* (2013.01); *B65H 2403/732* (2013.01); *B65H 2404/7414* (2013.01)

(58) Field of Classification Search
CPC ..... B65H 2404/7414; B65H 45/16; B65H 2403/732; B65H 45/14; B65H 2404/63
See application file for complete search history.

(56) References Cited

U.S. PATENT DOCUMENTS

2014/0141956 A1 5/2014 Suzuki et al.
2014/0364295 A1* 12/2014 Watanabe ..... B65H 45/14 493/436

(Continued)

FOREIGN PATENT DOCUMENTS

JP 2014-101164 A 6/2014
JP 2015-013751 A 1/2015

(Continued)

OTHER PUBLICATIONS

Extended European Search Report issued May 13, 2024 in European Patent Application No. 23214177.0, 5 pages.
U.S. Appl. No. 18/144,828, filed May 8, 2023.

*Primary Examiner* — Jennifer Bahls
(74) *Attorney, Agent, or Firm* — XSENSUS LLP

(57) ABSTRACT

A sheet folding apparatus includes a conveyor, a first folding roller, a second folding roller, a third folding roller, a guide, a motor, and a driving force transmission mechanism. The motor causes the second folding roller to perform either forward rotation in which the second folding roller rotates to convey a sheet on a main conveying path in a conveying direction and to convey the sheet on a reflux conveying path from a joining position toward a branching position or backward rotation in a direction opposite to the forward rotation. The driving force transmission mechanism rotates the guide toward a first posture from a second posture in conjunction with the forward rotation of the second folding roller and rotates the guide from the first posture toward the second posture in conjunction with the backward rotation of the second folding roller.

12 Claims, 19 Drawing Sheets

(56) References Cited

U.S. PATENT DOCUMENTS

| | | | |
|---|---|---|---|
| 2015/0360899 | A1 | 12/2015 | Takahashi et al. |
| 2016/0060072 | A1 | 3/2016 | Watanabe et al. |
| 2016/0068359 | A1 | 3/2016 | Suzuki et al. |
| 2016/0114999 | A1* | 4/2016 | Suzuki ..... B31F 1/0025 493/409 |
| 2016/0221787 | A1 | 8/2016 | Matsushita et al. |
| 2016/0340144 | A1 | 11/2016 | Sakano et al. |
| 2016/0340145 | A1 | 11/2016 | Kunieda et al. |
| 2016/0360053 | A1 | 12/2016 | Suzuki et al. |
| 2017/0174465 | A1 | 6/2017 | Morinaga et al. |
| 2017/0217239 | A1 | 8/2017 | Suzuki et al. |
| 2018/0259895 | A1 | 9/2018 | Shibasaki et al. |
| 2019/0276263 | A1 | 9/2019 | Hidaka et al. |
| 2019/0284006 | A1 | 9/2019 | Hoshino et al. |
| 2019/0284008 | A1 | 9/2019 | Sakano et al. |
| 2019/0284009 | A1 | 9/2019 | Suzuki et al. |
| 2019/0284010 | A1 | 9/2019 | Asami et al. |
| 2019/0284011 | A1 | 9/2019 | Furuhashi et al. |
| 2019/0284012 | A1 | 9/2019 | Yoneyama et al. |
| 2019/0367317 | A1 | 12/2019 | Haraguchi et al. |
| 2020/0103811 | A1 | 4/2020 | Sugiyama et al. |
| 2020/0239265 | A1 | 7/2020 | Suzuki et al. |
| 2020/0307936 | A1 | 10/2020 | Sugawara et al. |
| 2020/0307944 | A1 | 10/2020 | Shibasaki et al. |
| 2020/0385231 | A1 | 12/2020 | Kunieda et al. |
| 2020/0407187 | A1 | 12/2020 | Hidaka et al. |
| 2021/0039900 | A1 | 2/2021 | Shimazu et al. |
| 2021/0316955 | A1 | 10/2021 | Shibasaki et al. |
| 2021/0347589 | A1 | 11/2021 | Suzuki et al. |
| 2021/0403273 | A1 | 12/2021 | Haraguchi et al. |
| 2022/0055855 | A1 | 2/2022 | Shinoda et al. |
| 2022/0063953 | A1 | 3/2022 | Tanaka et al. |
| 2022/0289512 | A1 | 9/2022 | Takahashi et al. |
| 2022/0334523 | A1 | 10/2022 | Akiyama et al. |
| 2022/0363088 | A1 | 11/2022 | Yoshizawa et al. |
| 2022/0380166 | A1 | 12/2022 | Nozaki et al. |
| 2023/0001731 | A1 | 1/2023 | Haraguchi et al. |
| 2023/0331029 | A1 | 10/2023 | Suzuki et al. |
| 2023/0331507 | A1 | 10/2023 | Ota et al. |

FOREIGN PATENT DOCUMENTS

| | | | |
|---|---|---|---|
| JP | 2015-016975 | A | 1/2015 |
| JP | 2020-189717 | A | 11/2020 |

* cited by examiner

SHEET FOLDING APPARATUS, IMAGE FORMING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2022-195096, filed on Dec. 6, 2022, in the Japan Patent Office, the entire disclosure of which is hereby incorporated by reference herein.

TECHNICAL FIELD

Embodiments of the present disclosure relate to a sheet folding apparatus, an image forming apparatus, and an image forming system.

RELATED ART

A sheet folding apparatus that folds a sheet on which an image is formed by an image forming apparatus into a predetermined shape (for example, Z-fold, outer three-fold, and two-fold) has been known. Here, when an image forming system is configured by connecting a sheet folding apparatus to an existing image forming apparatus, there is a problem that the entire system is enlarged.

In order to solve such a problem, for example, a sheet folding apparatus has been proposed that can be mounted in a body of an image forming apparatus and is suitable for alternately folding inward and outward in the sheet conveying direction to perform a so-called Z-fold.

SUMMARY

According to an embodiment of the present disclosure, a sheet folding apparatus includes a conveyor, a first folding roller, a second folding roller, a third folding roller, a guide, a motor, and a driving force transmission mechanism. The conveyor conveys a sheet along a main conveying path in a conveying direction. The first folding roller and the second folding roller are disposed opposite to each other with the main conveying path interposed between the first folding roller and the second folding roller. The third folding roller is disposed opposite to the second folding roller with a reflux conveying path interposed between the third folding roller and the second folding roller. The reflux conveying path branches off from the main conveying path at a branching position upstream from the first folding roller in the conveying direction and joins the main conveying path at a joining position upstream from the branching position in the conveying direction. The guide switches between a first posture and a second posture. The guide in the first posture prevents the sheet conveyed on the main conveying path in the conveying direction from entering the reflux conveying path through the branching position. The guide in the second posture allows the sheet to be conveyed from one of the main conveying path and the reflux conveying path to the other of the main conveying path and the reflux conveying path through the branching position. The motor causes the second folding roller to perform either forward rotation in which the second folding roller rotates to convey the sheet on the main conveying path in the conveying direction and to convey the sheet on the reflux conveying path from the joining position toward the branching position or backward rotation in which the second folding roller rotates in a direction opposite to the forward rotation. The driving force transmission mechanism rotates the guide from the second posture toward the first posture in conjunction with the forward rotation of the second folding roller and rotates the guide from the first posture toward the second posture in conjunction with the backward rotation of the second folding roller.

According to another embodiment of the present disclosure, an image forming apparatus includes a housing, an image former, and the sheet folding apparatus. The image former is housed in the housing to form an image on a sheet. The sheet folding apparatus is detachably supported by the housing, to fold the sheet on which the image is formed by the image former.

According to still another embodiment of the present disclosure, an image forming system includes an image forming apparatus to form an image on a sheet and the sheet folding apparatus that is connected to the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
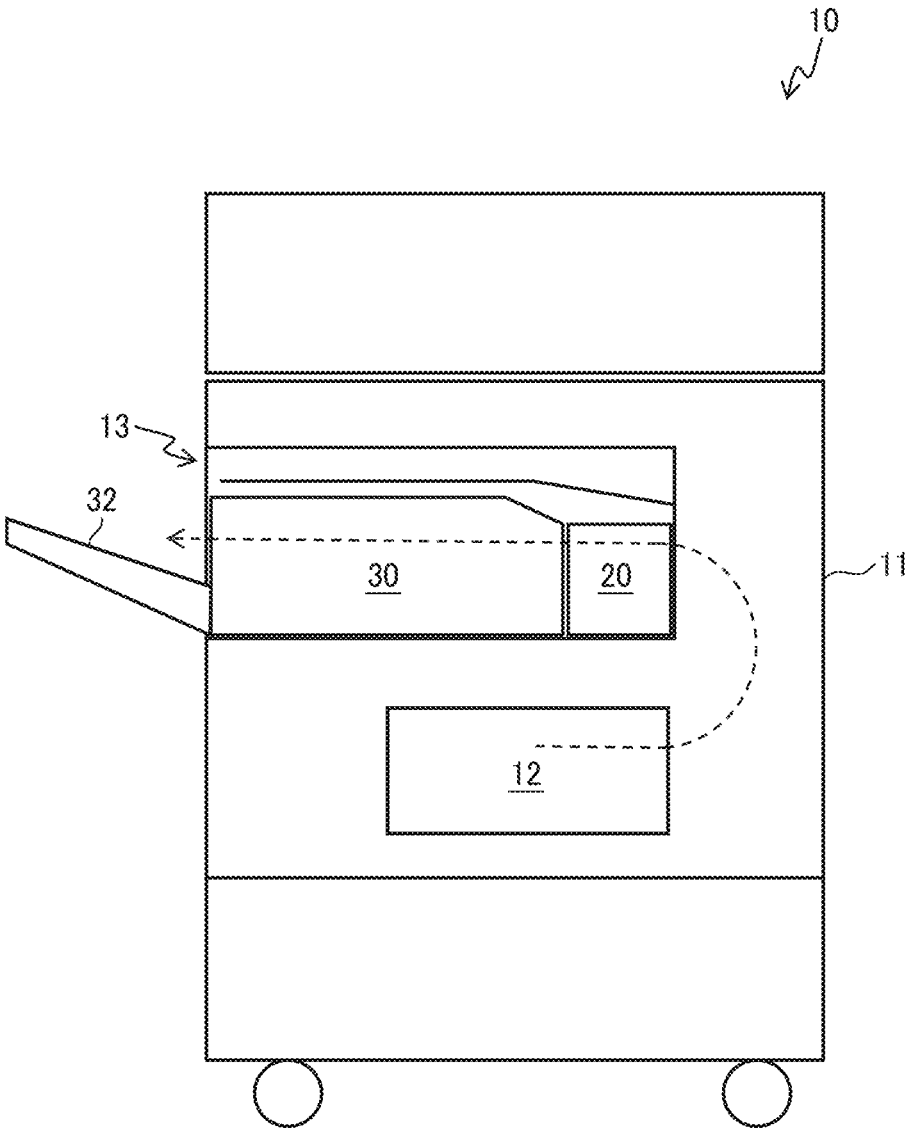
FIG. 1 is an external view of an image forming apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, an image forming apparatus 10 according to an embodiment of the present disclosure will be described with reference to the drawings. FIG. 1 is an external view of the image forming apparatus 10. The image forming apparatus 10 is an apparatus that forms an image on a sheet S (typically, a sheet of paper). As illustrated in FIG. 1, the image forming apparatus 10 includes a housing 11 and an image former 12.

The housing 11 has a box shape in which an internal space for accommodating components of the image forming apparatus 10 is formed. The housing 11 has an in-body space 13 accessible from the outside of the image forming apparatus 10. The in-body space 13 is located, for example, slightly above the center of the housing 11 in the vertical direction. The in-body space 13 is exposed to the outside by cutting out the outer wall of the housing 11. Further, the in-body space 13 has a sheet folding unit 20 (serving as a sheet folding apparatus), a sheet binding unit 30 (serving as a post-processing device), and a hole punch unit 50 (see FIGS. 18A to 18B) to be described later.

The image former 12 forms an image on the sheet S stored in the tray, and ejects the sheet S on which the image is formed to the sheet folding unit 20, the sheet binding unit 30, or the hole punch unit 50. The image former 12 may be an inkjet image forming device that forms an image with ink or an electrophotographic image forming device that forms an image with toner. Since the configuration of the image former 12 is already known, a detailed description thereof will be omitted.

The sheet folding unit 20 is attached to the in-body space 13 of the image forming apparatus 10 on the downstream side of the image former 12 and on the upstream side of the sheet binding unit 30 in the conveying path of the sheet S from the image former 12 to the sheet binding unit 30 (the path indicated by the dashed arrow in FIG. 1). That is, the sheet S on which an image is formed by the image former 12 is first delivered to the sheet folding unit and subjected to a folding process to be described later, and then delivered to the sheet binding unit 30 and subjected to a binding process to be described later.

The sheet folding unit 20 is detachably attached to the image forming apparatus 10. When the sheet folding unit 20 is removed, the sheet S on which an image is formed by the image former 12 is directly delivered to the sheet binding unit 30 and subjected to the binding process. Further, the hole punch unit 50 is detachably attached to a position where the sheet folding unit 20 is removed in the in-body space 13. When the hole punch unit 50 is attached, the sheet S on which an image is formed by the image former 12 is first delivered to the hole punch unit 50 and subjected to a punching process to be described later, and then delivered to the sheet binding unit 30 and subjected to a binding process. At the position where the sheet folding unit 20 is removed in the in-body space 13, a unit that performs an arbitrary process on the sheet S can be attached without being limited to the hole punch unit.

Figure 2:
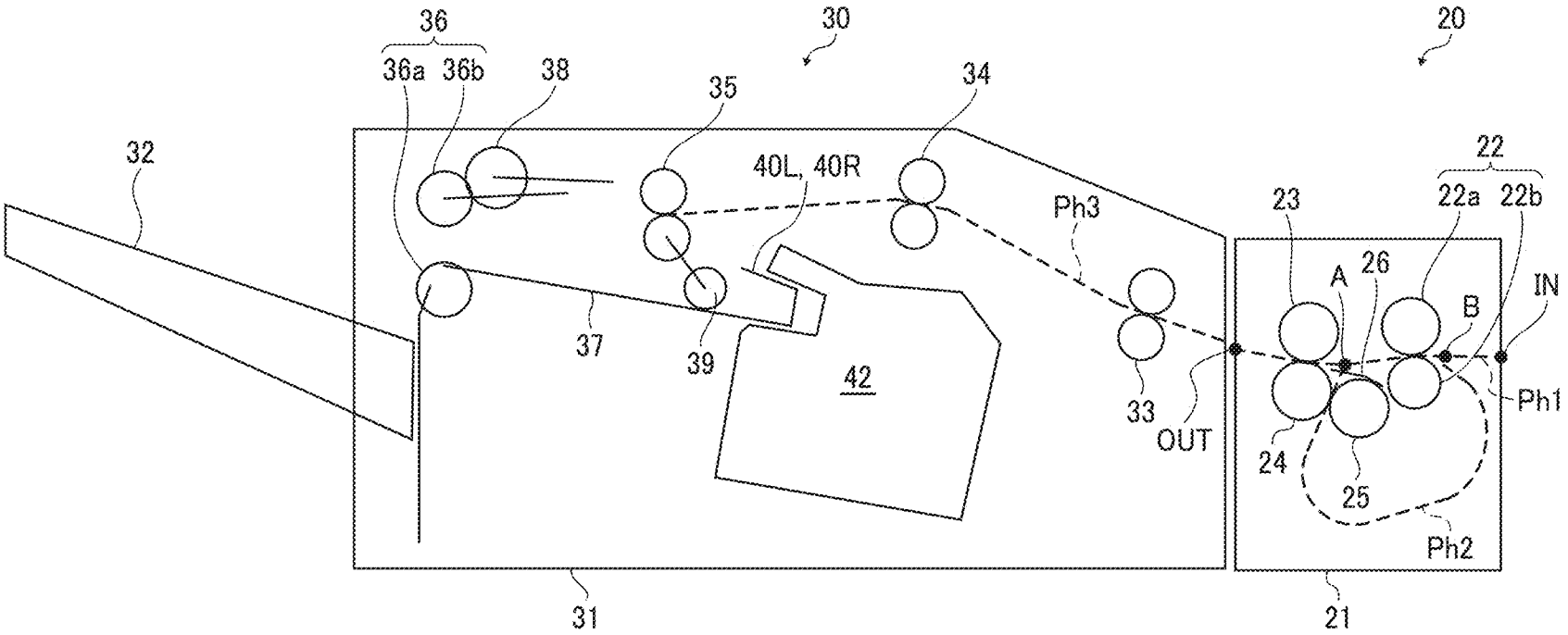
FIG. 2 is a diagram illustrating an internal configuration of a sheet folding unit and a sheet binding unit.

FIG. 2 is a diagram illustrating an internal configuration of the sheet folding unit 20 and the sheet binding unit 30. Each of the sheet folding unit 20 and the sheet binding unit 30 is unitized, and an input/output interface of the sheet S can be connected thereto. That is, the input interface IN of the sheet folding unit 20 is connected to the output interface of the image former 12. The input interface of the sheet binding unit 30 is connected to the output interface of the image former 12 and the output interface OUT of the sheet folding unit 20.

The sheet folding unit 20 executes a folding process of folding the sheet S on which an image is formed by the image former 12 into a predetermined shape (for example, Z-fold, outer three-fold, and two-fold). As illustrated in FIG. 2, the sheet folding unit 20 includes a housing 21, a conveyance roller pair 22 (serving as a conveyor), a first folding roller 23, a second folding roller 24, a third folding roller 25, a guide plate 26 (serving as a guide), a first stopper 27*a* and a second stopper 27*b* (see FIGS. 3A to 3B), and a driving force transmission mechanism 28 (see FIGS. 3A to 3B).

The housing 21 has a box shape in which an internal space for accommodating components of the sheet folding unit 20 is formed. The internal space of the housing 21 includes a main conveying path Ph1 and a reflux conveying path Ph2, which are spaces through which the sheet S passes. The main conveying path Ph1 is a conveying path from the input interface IN connected to the image former 12 to the output interface OUT connected to the sheet binding unit 30. Hereinafter, a direction from the input interface IN to the output interface OUT on the main conveying path PHI is referred to as a "conveying direction". The reflux conveying path Ph2 is an annular conveying path that branches from the main conveying path PHI at a branching position A and joins the main conveying path Ph1 at a joining position B. The joining position B is located on the upstream side of the branching position A in the conveying direction.

The conveyance roller pair 22 conveys the sheet S in the conveying direction along the main conveying path Ph1. The conveyance roller pair 22 includes a driving roller 22*a* and a driven roller 22*b* arranged to face each other with the main conveying path Ph1 interposed therebetween on the upstream side in the conveying direction of the branching position A and on the downstream side in the conveying direction of the joining position B (that is, between the branching position A and the joining position B). The driving roller 22*a* and the driven roller 22*b* are rotatably supported by the housing 21. The driving roller 22*a*, to which the driving force of a conveyance motor 22*c* (see FIG. 4) is transmitted, rotates forward in the direction of conveying the sheet S in the conveying direction (clockwise in FIG. 2). The driven roller 22*b* is arranged to face the driving roller 22*a* with the main conveying path Ph1 interposed therebetween, and is driven with the rotation of the driving roller 22*a*. Then, when the conveyance motor 22*c* is driven in a state where the driving roller 22*a* and the driven roller 22*b* clamp the sheet S, the sheet S is conveyed in the conveying direction along the main conveying path Ph1.

The first folding roller 23 is rotatably supported by the housing 21 at a position facing the main conveying path Ph1. The second folding roller 24 is rotatably supported by the housing 21 at a position facing both the main conveying path Ph1 and the reflux conveying path Ph2. The third folding roller 25 is rotatably supported by the housing 21 at a position facing the reflux conveying path Ph2. The first folding roller 23 and the second folding roller 24 are arranged to face each other with the main conveying path Ph1 interposed therebetween on the downstream side in the conveying direction of the branching position A. Further, the second folding roller 24 and the third folding roller 25 are arranged to face each other with the reflux conveying path Ph2 interposed therebetween between at the branching position A and the joining position B.

The first folding roller 23 rotates forward and backward when the driving force of the first folding motor 23*a* (see FIG. 4) is transmitted. The forward rotation of the first folding roller 23 is rotation in a direction conveying the sheet S on the main conveying path Ph1 in the conveying direction. The backward rotation of the first folding roller 23 is a rotation in a direction opposite to the forward rotation. The first folding motor 23*a* can perform forward rotation of forward rotating the first folding roller 23 and backward rotation of backward rotating the first folding roller 23.

The second folding roller 24 rotates forward and backward when the driving force of the second folding motor 24*a* (see FIG. 4) is transmitted. The forward rotation of the second folding roller 24 is rotation in a direction of conveying the sheet S on the main conveying path Ph1 in the conveying direction and conveying the sheet S on the reflux conveying path Ph2 from the joining position B toward the branching position A. The backward rotation of the second folding roller 24 is a rotation in a direction opposite to the forward rotation. The second folding motor 24*a* (motor) can perform forward rotation of forward rotating the second folding roller 24 and backward rotation of backward rotating the second folding roller 24.

Figure 4:
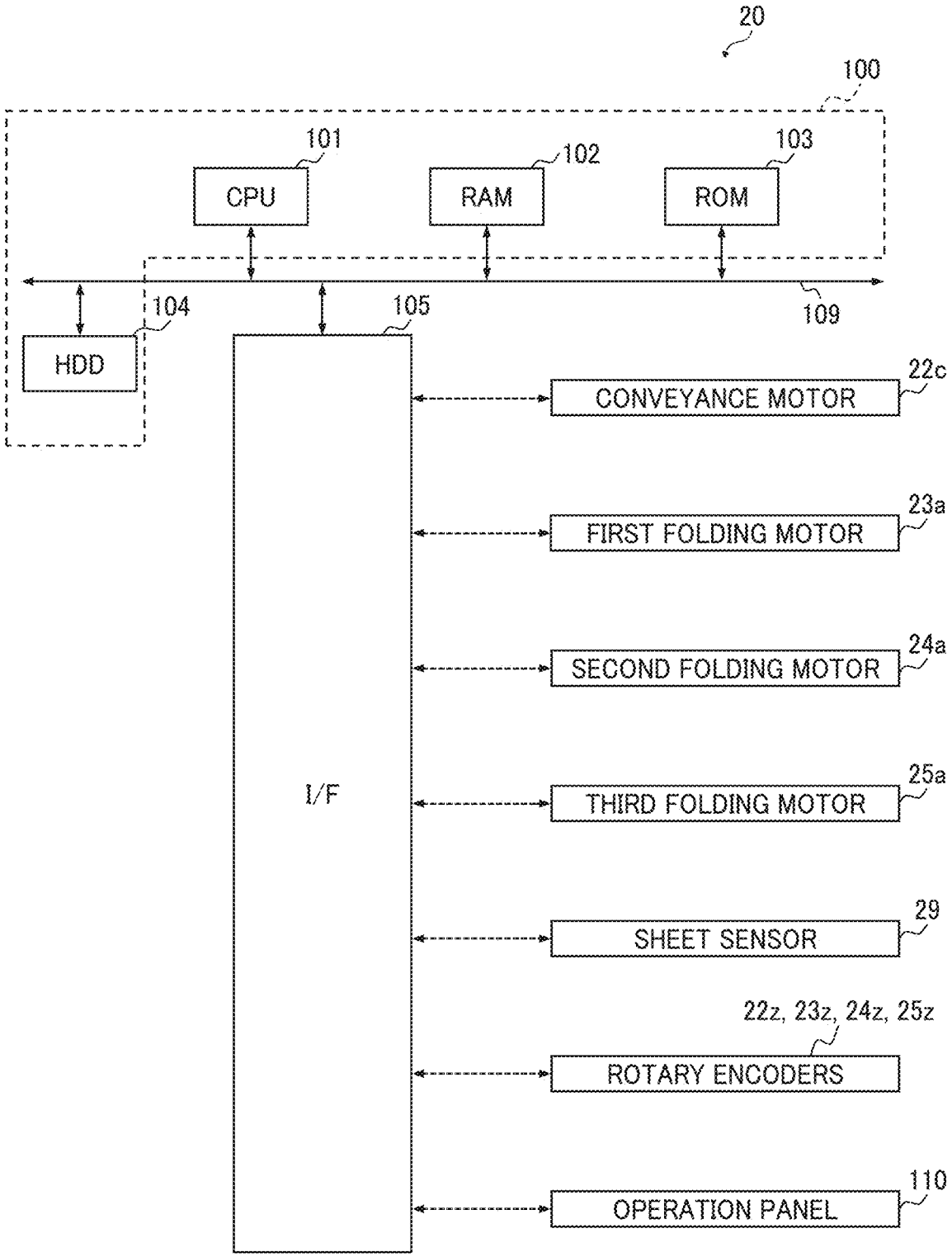
FIG. 4 is a hardware configuration diagram of the sheet folding unit.

The third folding roller 25 is rotated forward and backward by the transmission of the driving force of the third folding motor 25*a* (see FIG. 4). The forward rotation of the third folding roller 25 is rotation in a direction of conveying the sheet S on the reflux conveying path Ph2 from the joining position B toward the branching position A. The backward rotation of the third folding roller 25 is a rotation in a direction opposite to the forward rotation. The third folding motor 25*a* can perform forward rotation of forward rotating the third folding roller 25 and backward rotation of backward rotating the third folding roller 25.

The guide plate 26 is rotatably supported by the housing 21 in the vicinity of the branching position A. The guide plate 26 rotates between a first posture illustrated in FIGS. 7B and 10B and a second posture illustrated in FIGS. 8B and 9B. The first posture is a posture of the guide plate 26 that allows the sheet S to be conveyed on the main conveying path Ph1 in the conveying direction and prevents the sheet S conveyed on the main conveying path Ph1 in the conveying direction from entering the reflux conveying path Ph2 through the branching position A. On the other hand, the guide plate 26 in the first posture allows the sheet S on the reflux conveying path Ph2 to enter the main conveying path Ph1 through the branching position A. The second posture is a posture of the guide plate 26 that allows the sheet S to be conveyed from one of the main conveying path Ph1 and the reflux conveying path Ph2 to the other through the branching position A.

Figure 7B:
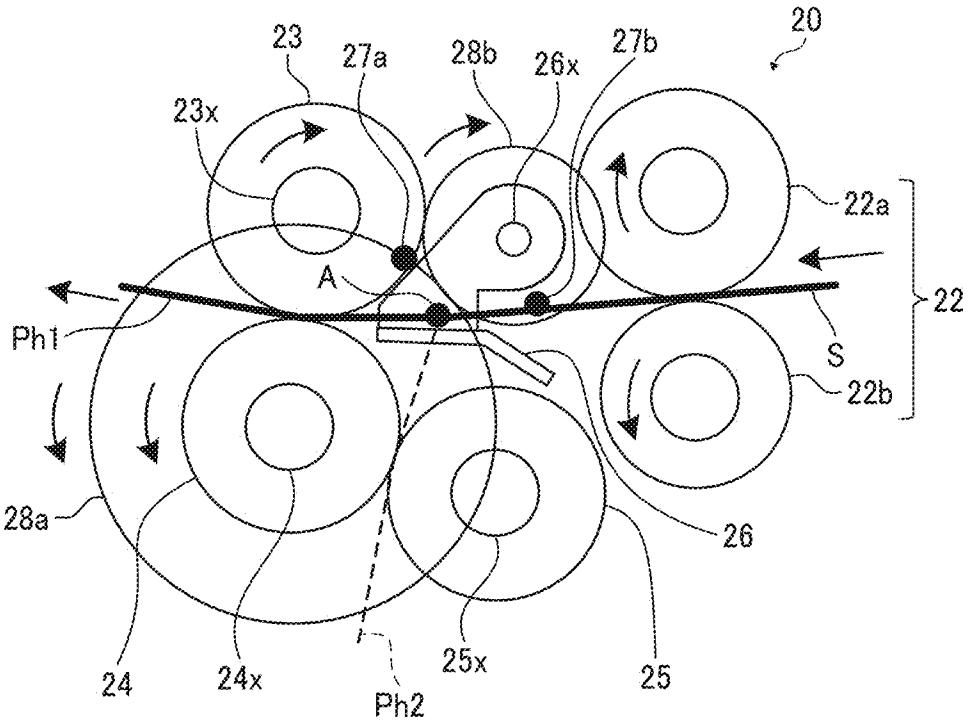
FIGS. 7A to 7B are views illustrating a state of the sheet folding unit before a sheet is folded at a first folding position.
Figure 8B:
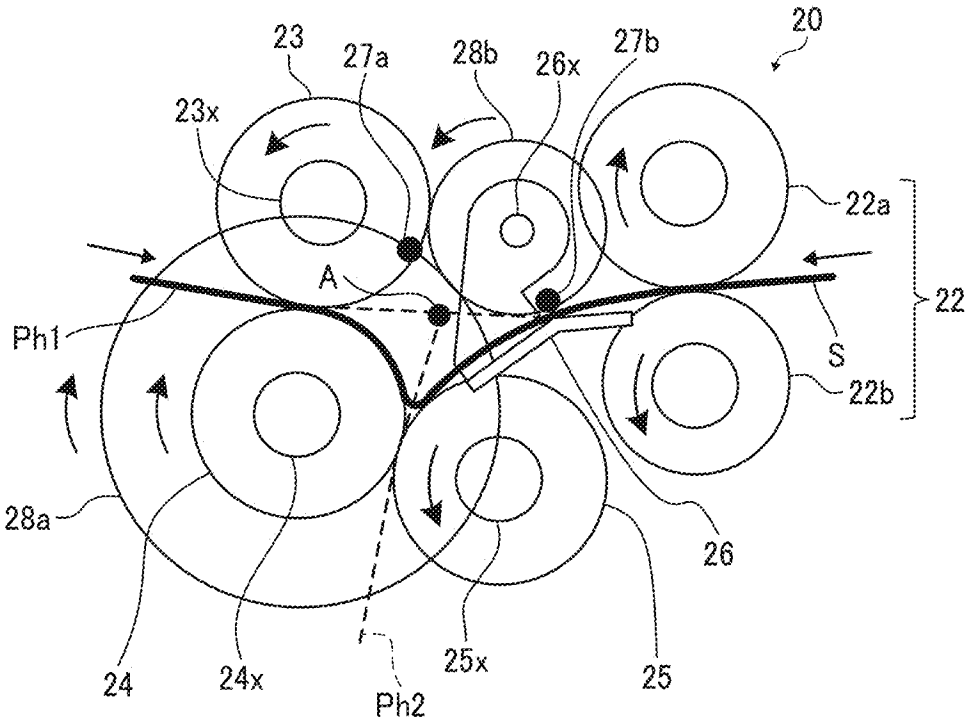
FIGS. 8A to 8B are views illustrating a state of the sheet folding unit when the sheet is folded at the first folding position.
Figure 9B:
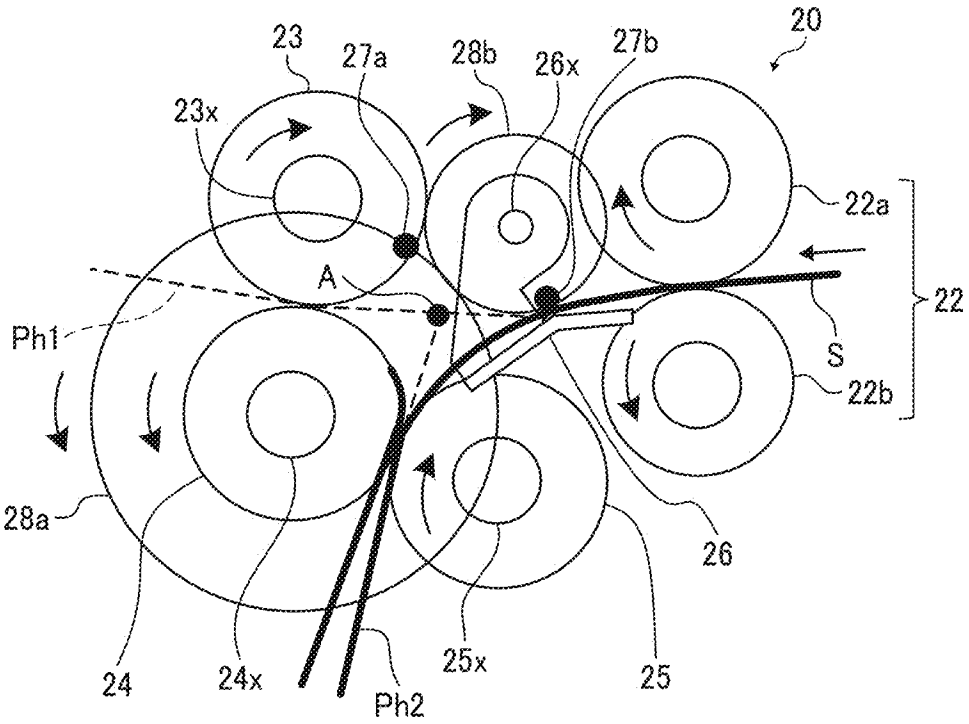
FIGS. 9A to 9B are views illustrating a state of the sheet folding unit before the sheet is folded at a second folding position.
Figure 10B:
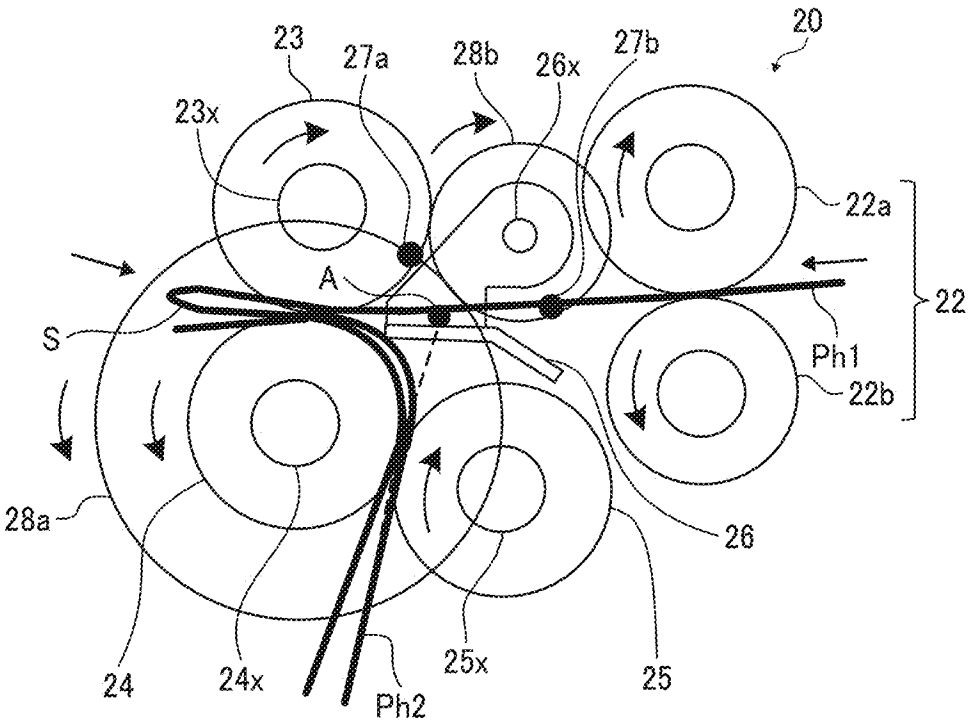
FIGS. 10A to 10B are views illustrating a state of the sheet folding unit after the sheet is folded at the second folding position.

As illustrated in FIGS. 7B and 10B, the first stopper 27*a* abuts on the guide plate 26 in the first posture to prevent the guide plate 26 from rotating in a direction away from the second posture (clockwise in FIGS. 7B and 10B). As illustrated in FIGS. 8B and 9B, the second stopper 27*b* abuts on the guide plate 26 in the second posture to prevent the guide plate 26 from rotating in a direction away from the first posture (counterclockwise in FIGS. 8B and 9B). As a result, the guide plate 26 rotates between the first posture and the second posture (in other words, between the first stopper 27*a* and the second stopper 27*b*). In other words, the first stopper 27*a* and the second stopper 27*b* restrict the rotation range of the guide plate 26.

Figure 3A:
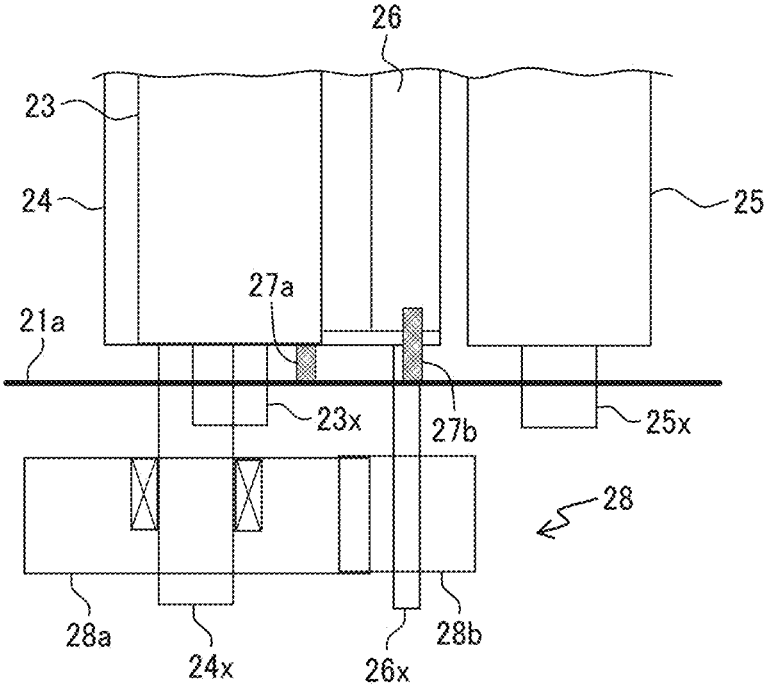
FIGS. 3A and 3B are views of the sheet folding unit as viewed from a direction (A) orthogonal to a sheet on a main conveying path and a width direction (B) of the sheet.
Figure 3B:
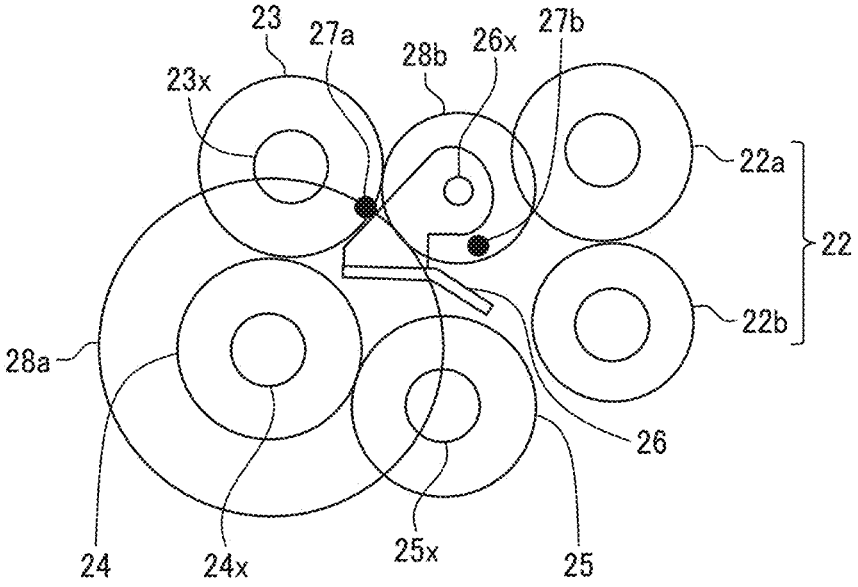

FIGS. 3A to 3B are views of the sheet folding unit 20 viewed from a direction (A) orthogonal to the sheet S and a width direction (B) of the sheet S on the main conveying path Ph1. As illustrated in FIGS. 3A to 3B, rotation shafts 23*x*, 24*x*, 25*x*, and 26*x* of the first folding roller 23, the second folding roller 24, the third folding roller 25, and the guide plate 26 extend in the width direction of the sheet S. The rotation shafts 23*x*, 24*x*, 25*x*, and 26*x* pass through a partition wall 21*a* provided inside the housing 21. The driving force transmission mechanism 28 is disposed on the side opposite to the first folding roller 23, the second folding roller 24, the third folding roller 25, and the guide plate 26 with the partition wall 21*a* interposed therebetween.

The driving force transmission mechanism 28 distributes the driving force of the second folding motor 24*a* to the second folding roller 24 and the guide plate 26 to drive the second folding roller 24 and the guide plate 26 in conjunction with each other. More particularly, the driving force transmission mechanism 28 rotates the guide plate 26 from the second posture toward the first posture in conjunction with the forward rotation of the second folding roller 24. The driving force transmission mechanism 28 rotates the guide plate 26 from the first posture toward the second posture in conjunction with the backward rotation of the second folding roller 24. As illustrated in FIGS. 3A to 3B, the driving force transmission mechanism 28 includes, for example, a torque limiter 28*a* and a driven gear 28*b*.

An output shaft of the second folding motor 24*a* is connected to the rotation shaft 24*x* of the second folding roller 24. The torque limiter 28*a* is attached to the rotation shaft 24*x* of the second folding roller 24 and rotates integrally with the second folding roller 24. The driven gear 28*b* is attached to the rotation shaft 26*x* of the guide plate 26 and rotates integrally with the guide plate 26. The torque limiter 28*a* and the driven gear 28*b* are meshed with each other.

Thus, the driving force of the second folding motor 24*a* is transmitted to the second folding roller 24, and is also transmitted to the guide plate 26 through the torque limiter 28*a* and the driven gear 28*b*. More particularly, when the second folding motor 24*a* rotates forward, the second folding roller 24 rotates forward, and the guide plate 26 rotates from the second posture toward the first posture. On the other hand, when the second folding motor 24*a* rotates backward, the second folding roller 24 rotates backward, and the guide plate 26 rotates from the first posture toward the second posture.

The torque limiter 28*a* transmits the driving force of the second folding motor 24*a* to the driven gear 28*b* (in other words, the guide plate 26) when the rotational torque is less than the threshold (that is, the guide plate 26 is separated from the first stopper 27*a* and the second stopper 27*b*). On the other hand, the torque limiter 28*a* releases (that is, idling) the transmission of the driving force from the second folding motor 24*a* to the driven gear 28*b* (in other words, the guide plate 26) when the rotational torque is equal to or greater than the threshold (that is, the guide plate 26 abuts on the first stopper 27*a* and the second stopper 27*b*). Since the configuration of the torque limiter 28*a* for switching transmission and transmission release of the driving force is already known, a detailed description thereof will be omitted.

Furthermore, the number of teeth Z1 of the torque limiter 28*a* is larger than the number of teeth Z2 of the driven gear 28*b* (Z1>Z2). As a result, the driving force transmission mechanism 28 accelerates the rotation of the second folding motor 24*a* and transmits the accelerated rotation to the guide plate 26. More particularly, when the second folding motor 24*a* makes one rotation, the second folding roller 24 rotates by the first rotation speed (for example, one rotation), whereas the guide plate 26 rotates by the second rotation speed (for example, Z1/Z2) larger than the first rotation speed. As a result, the posture of the guide plate 26 can be quickly changed.

The sheet folding unit 20 includes a sheet sensor 29 (see FIG. 4) that detects that the sheet S has reached a predetermined position on the main conveying path Ph1 or the reflux conveying path Ph2, and rotary encoders 22*z*, 23*z*, 24*z*, and 25*z* (see FIG. 4) that detect the rotation speeds of the rollers 22*a*, 23, 24, and 25. A controller 100 to be described later can grasp the position of the sheet S on the main conveying path Ph1 and the reflux conveying path Ph2 based on the detection results of the sheet sensor 29 and the rotary encoders 22*z*, 23*z*, 24*z*, and 25*z*.

More particularly, the controller 100 grasps the position of the sheet S based on the number of pulse signals output from the rotary encoders 22*z*, 23*z*, 24*z*, and 25*z* after the sheet S is detected by the sheet sensor 29. Thus, the timing of steps S602, S604, S606, S1102, S1104, and S1106 to be described later is detected. Note that the installation position of the sheet sensor 29 is not limited to one position, and may be a plurality of positions.

The sheet binding unit 30 performs a binding process (post-process) of binding a plurality of sheets S (hereinafter, referred to as a "sheet bundle Sb") on which an image is formed by the image former 12. In the present embodiment, the sheet binding unit 30 will be described as an example of the post-processing device, but a specific example of the post-processing device (or post-process) is not limited thereto. As illustrated in FIG. 2, the sheet binding unit 30 includes a housing 31, an ejection tray 32, a plurality of conveyance roller pairs 33, 34, 35, and 36, an inner tray 37, a tapping roller 38, a return roller 39, end fences 40L and 40R, side fences 41L and 41R (see FIG. 16), and a binding processor 42.

The housing 31 has a box shape in which an internal space for accommodating components of the sheet binding unit 30 is formed. The internal space of the housing 31 includes a conveying path Ph3, which is a space through which the sheet S passes. The ejection tray 32 is supported by an outer surface of the housing 31. The ejection tray 32 supports the sheet S or the sheet bundle Sb conveyed by the conveyance roller pairs 33 to 36.

The conveyance roller pairs 33 to 36 are disposed on the conveying path Ph3 at a predetermined interval. The conveyance roller pairs 33 to 36 convey the sheet S along the conveying path Ph3. A basic configuration of the conveyance roller pairs 33 to 36 is common to the conveyance roller pair 22 of the sheet folding unit 20. However, the conveyance roller pair 36 includes a driving roller 36*a* and a driven roller 36*b* that can come into and out of contact with the driving roller 36*a*. Further, the conveyance roller pair 35 may slide in the width direction in order to implement a sorting process of shifting the sheet S in the width direction and ejecting the sheet S to the ejection tray 32.

The inner tray 37 temporarily supports (stacks) the plurality of sheets S sequentially conveyed on the conveying path Ph3. The tapping roller 38 is supported at a tip end of a rotation arm above the inner tray 37. The tapping roller 38 rotates the rotation arm to supply the sheet S clamped by the conveyance roller pair 36 to the inner tray 37. The return roller 39 abuts on the top surface of the sheet S supported by the inner tray 37 and rotates to guide the sheet S toward the end fences 40L and 40R.

The end fences 40L and 40R abut on the end portion on the downstream side in the conveying direction of the sheet S supported by the inner tray 37 to align the position of the sheet S in the conveying direction. The side fences 41L and 41R abut on both end portions in the width direction of the sheet S supported by the inner tray 37 to align the position of the sheet S in the width direction. The binding processor 42 executes a binding process of binding the sheet bundle Sb supported by the inner tray 37. The binding process executed by the binding processor 42 may be a needle binding process of inserting a binding needle into the sheet bundle Sb and binding the sheet bundle Sb, or may be a crimp binding process of pressure-deforming and binding the sheet bundle Sb. Further, the sheet binding unit 30 may include a needle binding processor that executes a needle binding process and a crimp binding processor that executes a crimping process, the needle binding processor and the crimp binding processor being operated independently of each other at positions separated in the width direction.

In addition, a manual staple slit may be provided at a position facing the binding processor 42 of the housing 31. Then, the user may insert the sheet bundle into the binding processor 42 through the manual staple slit and press a manual staple button of an operation panel 110 to be described later so that the binding processor 42 can execute the binding process.

FIG. 4 is a hardware configuration diagram of the sheet folding unit 20. As illustrated in FIG. 4, the sheet folding unit 20 has a configuration in which a central processing unit (CPU) 101, a random access memory (RAM) 102, a read only memory (ROM) 103, a hard disk drive (HDD) 104, and an interface (I/F) 105 are connected via a common bus 109.

The CPU 101 is a calculation unit, and controls the entire operation of the sheet folding unit 20. The RAM 102 is a volatile storage medium that allows data to be read and written at high speed. The CPU 101 uses the RAM 102 as a working area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an operating system (OS), various control programs, and application programs.

The sheet folding unit 20 processes a control program stored in the ROM 103, an information processing program (application program) loaded from a storage medium such as the HDD 104 to the RAM 102, and the like by an arithmetic function of the CPU 101. Through the process, a software controller including various functional modules of the sheet folding unit 20 is configured. The combination of the software controller configured as described above and hardware resources mounted on the sheet folding unit 20 constitutes a functional block that implements the function of the sheet folding unit 20. That is, the CPU 101, the RAM 102, the ROM 103, and the HDD 104 constitute a controller 100 that controls the operation of the sheet folding unit 20.

The I/F 105 is an interface that connects the conveyance motor 22*c*, the first folding motor 23*a*, the second folding motor 24*a*, the third folding motor 25*a*, the sheet sensor 29, the rotary encoders 22*z*, 23*z*, 24*z*, and 25*z*, and the operation panel 110 to the common bus 10). The controller 100 acquires information from the sheet sensor 29, the rotary encoders 22*z*, 23*z*, 24*z*, and 25*z*, and the operation panel 110 through the I/F 105, and operates the conveyance motor 22*c*, the first folding motor 23*a*, the second folding motor 24*a*, and the third folding motor 25*a*.

Note that although only the components of the sheet folding unit 20 are illustrated in FIG. 4, the controller 100 may also control the operations of the image former 12 and the sheet binding unit 30. Further, the controller 100 may communicate with a controller that controls the operation of the image former 12 and a controller that controls the operation of the sheet binding unit 30 to operate the sheet folding unit 20 in conjunction with the image former 12 and the sheet binding unit 30.

The operation panel 110 includes an operation device that receives instructions from a user and a display serving as an indicator that notifies the user of information. The operation device includes, for example, physical input buttons and a touch panel overlaid on a display. The operation panel 110 acquires information from the operator through the operation device and provides the operator with information through the display. Examples of the indicator are not limited to the display and may be, for example, a light emitting diode (LED) lamp or a speaker.

Figure 5A:
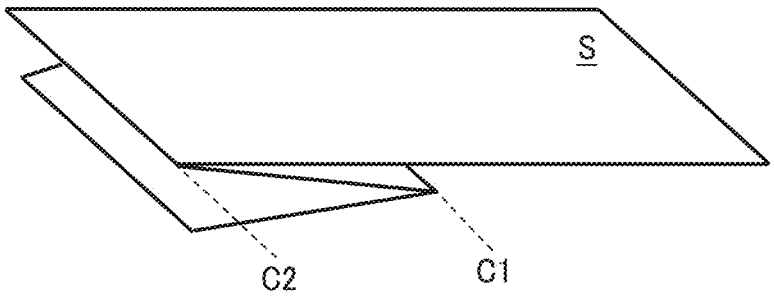
FIGS. 5A to 5C are views for describing variations of a folding method that are implemented by the sheet folding unit.
Figure 5B:
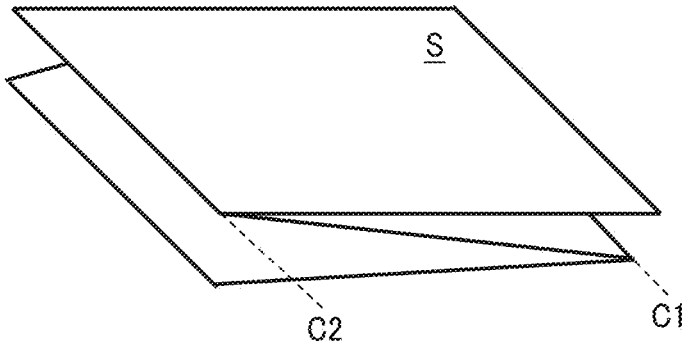
Figure 5C:
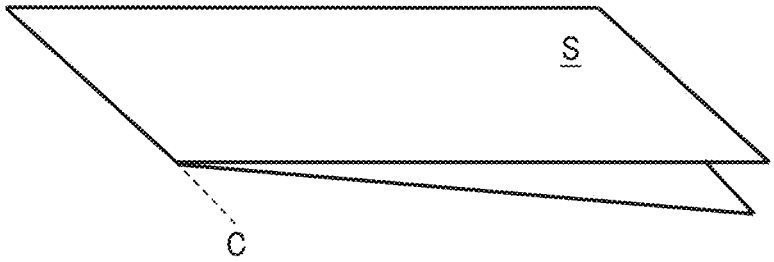

FIGS. 5A to 5C are views for describing variations of a folding method that are implemented by the sheet folding unit 20. FIG. 5A is a view in which the sheet S having the total length L in the conveying direction is folded in opposite directions at a first folding position C1 of L/4 from the front end and a second folding position C2 of L/2 (that is, the upstream side of the first folding position in the conveying direction) from the front end to form the so-called "Z-fold". FIG. 5B is a view in which the sheet S having the total length L in the conveying direction is folded in opposite directions at a first folding position C1 of L/3 from the front end and a second folding position C2 of 2 L/3 (that is, the upstream side of the first folding position in the conveying direction) from the front end to form the so-called "outer three-fold". FIG. 5C is a view in which the sheet S having the total length L in the conveying direction is folded at a folding position C of L/2 from the front end to form the so-called "two-fold".

Figure 6:
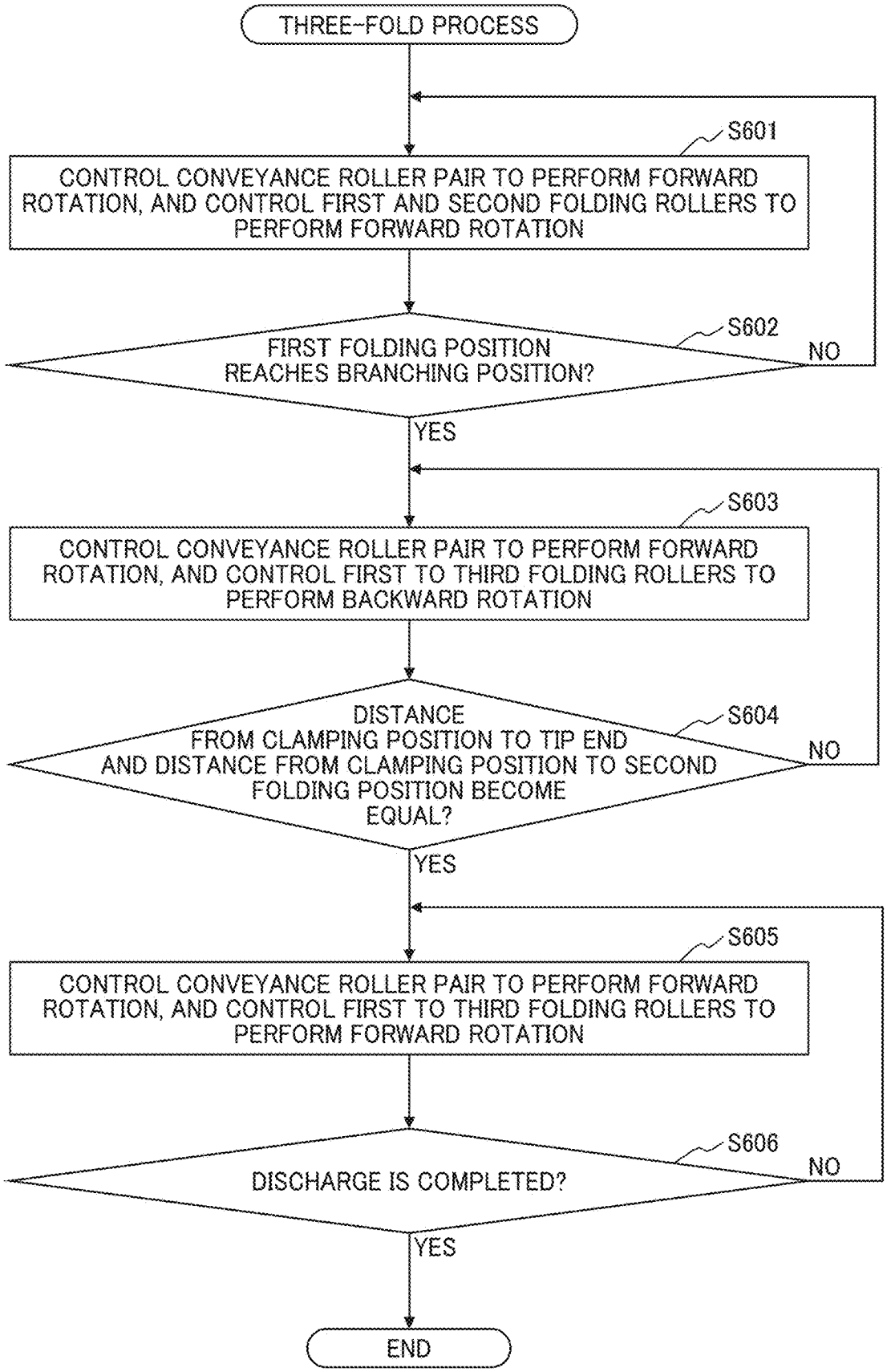
FIG. 6 is a flowchart of a three-fold process.
Figure 7A:
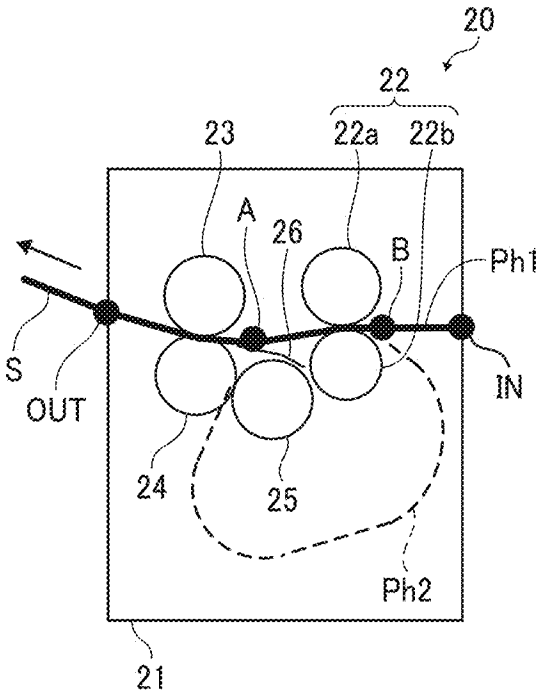
Figure 8A:
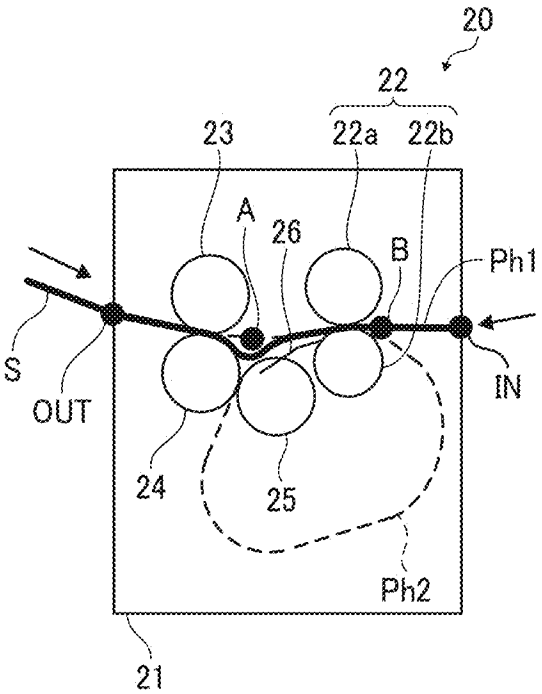
Figure 9A:
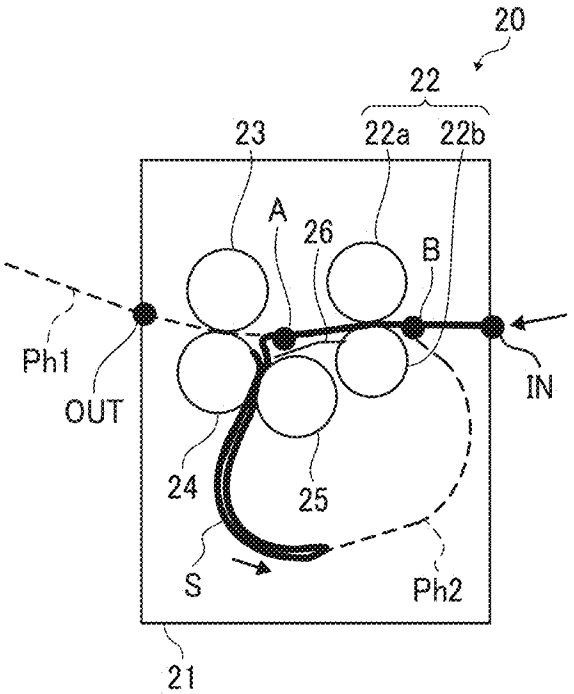
Figure 10A:
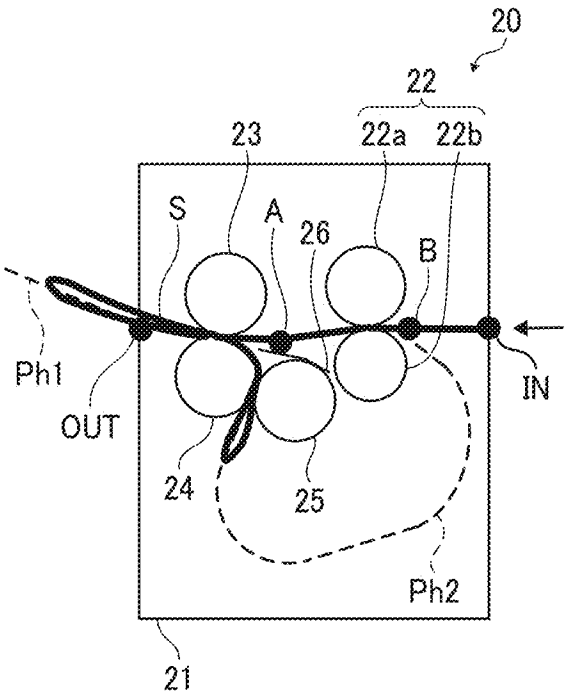

Next, a three-fold process of folding the sheet S in three will be described with reference to FIGS. 6 to 10. FIG. 6 is a flowchart of a three-fold process. FIGS. 7A to 7B are views illustrating a state of the sheet folding unit 20 before the sheet S is folded at the first folding position C1. FIGS. 8A to 8B are views illustrating a state of the sheet folding unit 20 when the sheet S is folded at the first folding position C1. FIGS. 9A to 9B are views illustrating a state of the sheet folding unit 20 before the sheet S is folded at the second folding position C2. FIGS. 10A to 10B are views illustrating a state of the sheet folding unit after the sheet S is folded at the second folding position C2.

The controller 100 starts the three-fold process illustrated in FIG. 6 in response to the sheet S being supplied from the image former 12 through the input interface IN. Note that how to fold the sheet S (in other words, the locations of the folding positions C1 and C2 in the conveying direction) may be instructed by the user through the operation panel 110 or may be instructed from an external apparatus through a communication network. That is, when the folding positions C1 and C2 are shifted in the conveying direction, both the Z-fold illustrated in FIG. 5A and the outer three-fold illustrated in FIG. 5B are implemented.

First, the controller 100 controls the conveyance roller pair 22, the first folding roller 23, and the second folding roller 24 to perform the forward rotation (S601). As a result, as illustrated in FIGS. 7A to 7B, the posture of the guide plate 26 changes to the first posture. The sheet S supplied through the input interface IN is conveyed in the conveying direction along the main conveying path Ph1. Then, the controller 100 continues the process of step S601 until the first folding position C1 reaches the branching position A (S602: No).

Next, at the timing when the first folding position C1 reaches the branching position A (S602: Yes), the controller 100 controls the conveyance roller pair 22 to perform the forward rotation, and the first folding roller 23, the second folding roller 24, and the third folding roller 25 to perform the backward rotation (S603). As a result, as illustrated in FIGS. 8A to 8B, the posture of the guide plate 26 changes to the second posture. Further, the sheet S enters the reflux conveying path Ph2 with the first folding position C1 as a head, and is clamped by the second folding roller 24 and the third folding roller 25. As a result, the sheet S is folded at the first folding position C1. Then, as illustrated in FIGS. 9A to 9B, the controller 100 continues the process of step S603 until the distance D1 from the clamping position between the first folding roller 23 and the second folding roller 24 to the front end of the sheet S and the distance D2 from the clamping position to the second folding position C2 become equal (S604: No).

Next, the controller 100 controls, at a timing when the distances D1 and D2 become equal (S605: Yes), the conveyance roller pair 22, the first folding roller 23, and the second folding roller 24 to perform the forward rotation (S605). As a result, as illustrated in FIGS. 10A to 10B, the posture of the guide plate 26 changes to the first posture. Further, the sheet S enters the clamping position between the first folding roller 23 and the second folding roller 24 with the front end and the second folding position C2 of the sheet S as the head. As a result, the sheet S is folded at the second folding position C2, and the Z-fold is completed.

Then, the controller 100 continues the process of step S605 until the rear end of the sheet S passes through the clamping position between the first folding roller 23 and the second folding roller 24 in the conveying direction (S606: No), that is, until the ejection of the sheet S three-folded is completed. Furthermore, at a timing when the rear end of the sheet S passes through the clamping position between the first folding roller 23 and the second folding roller 24 in the conveying direction (S606: Yes), the controller 100 stops the conveyance roller pair 22, the first folding roller 23, and the second folding roller 24, and ends the three-fold process.

Figure 11:
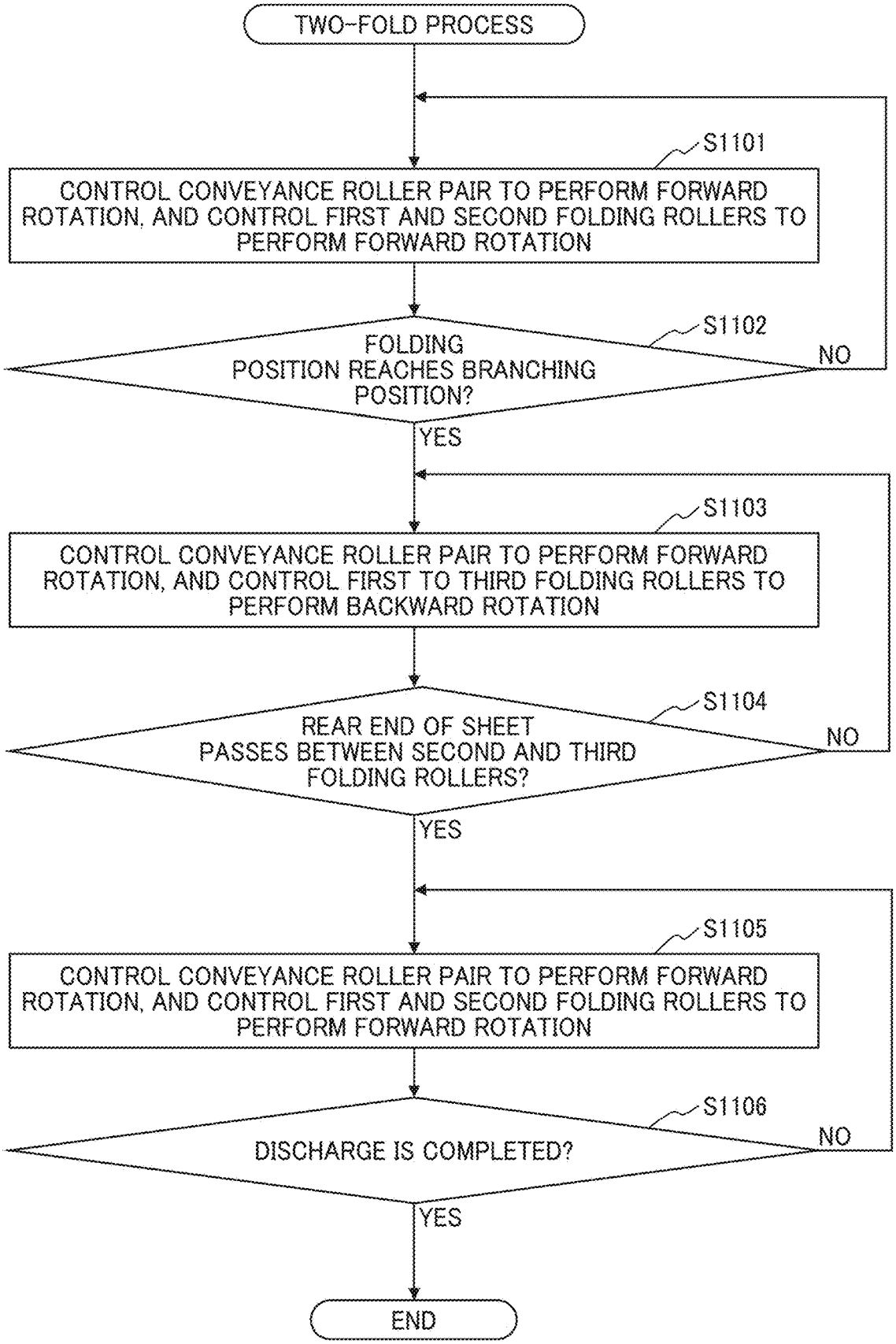
FIG. 11 is a flowchart of a two-fold process.

Next, a two-fold process of folding the sheet S in two will be described with reference to FIGS. 11 and 12A to 12F. FIG. 11 is a flowchart of a two-fold process, FIGS. 12A to 12F are views illustrating a state of the sheet folding unit 20 during the two-fold process. Note that detailed description of points in common with the three-fold process will be omitted, and differences will be mainly described.

Figure 12A:
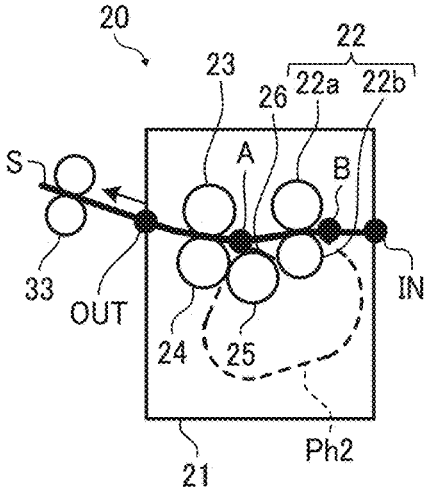
FIGS. 12A to 12F are views illustrating a state of the sheet folding unit during the two-fold process.

First, the controller 100 controls the conveyance roller pair 22, the first folding roller 23, and the second folding roller 24 to perform the forward rotation (S1101). As a result, as illustrated in FIG. 12A, the posture of the guide plate 26 changes to the first posture, and the sheet S is conveyed in the conveying direction along the main conveying path Ph1. Then, the controller 100 continues the process of step S1101 until the folding position C reaches the branching position A (S1102: No).

Figure 12B:
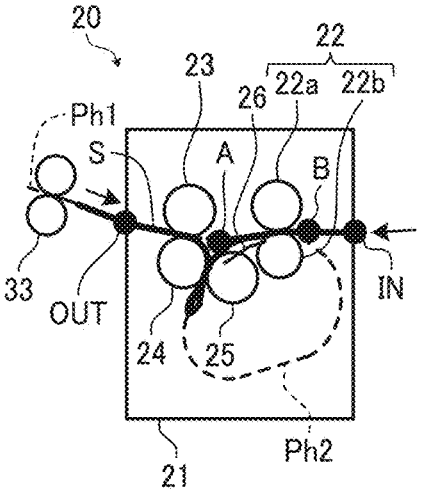
Figure 12C:
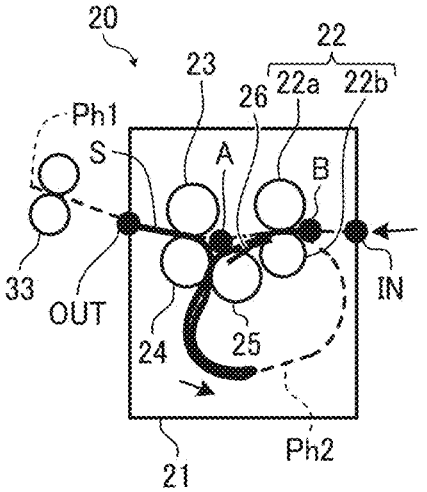
Figure 12D:
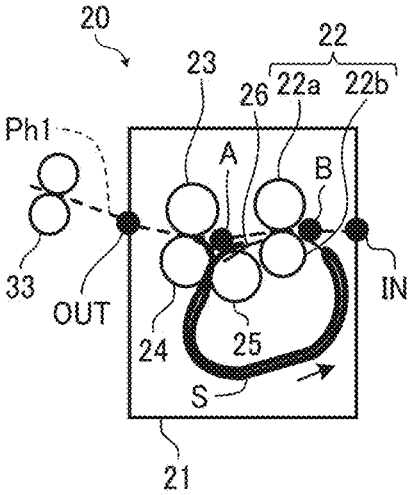

Next, the controller 100 controls, at a timing when the folding position C reaches the branching position A (S1102: Yes), the conveyance roller pair 22 to perform the forward rotation, and the first folding roller 23, the second folding roller 24, and the third folding roller 25 to perform the backward rotation (S1103). As a result, as illustrated in FIGS. 12B to 12D, the posture of the guide plate 26 changes to the second posture, and the sheet S enters the reflux conveying path Ph2 with the folding position C as the head. Then, the sheet S is two-folded at the folding position C by being clamped by the second folding roller 24 and the third folding roller 25. Then, the controller 100 continues the processing of step S1103 until the rear end of the sheet S passes through the clamping position between the second folding roller 24 and the third folding roller 25 (S1104: No).

Figure 12E:
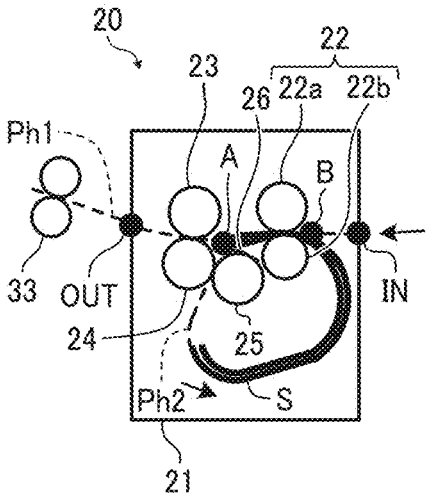
Figure 12F:
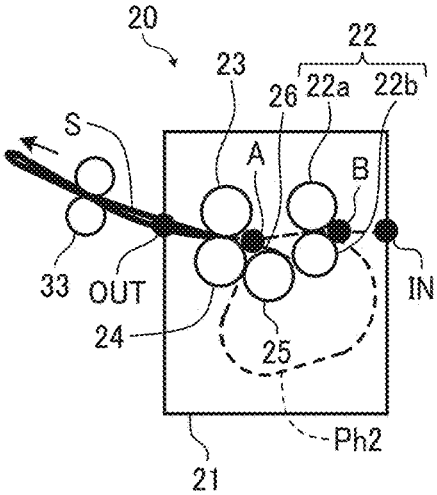

Next, the controller 100 controls, at a timing when the rear end of the sheet S passes through the clamping position between the second folding roller 24 and the third folding roller (S1104: Yes), the first folding roller 23 and the second folding roller 24 to perform the forward rotation (S1105). The controller 100 continues the forward rotation of the conveyance roller pair 22. As a result, as illustrated in FIGS. 12E and 12F, the posture of the guide plate 26 changes to the first posture, and the sheet S passes through the clamping position between the first folding roller 23 and the second folding roller 24 with the folding position C as the head.

Then, the controller 100 continues the process of step S1105 until the rear end of the sheet S passes through the clamping position between the first folding roller 23 and the second folding roller 24 in the conveying direction (S1106: No), that is, until the ejection of the sheet S two-folded is completed. Furthermore, at a timing when the rear end of the sheet S passes through the clamping position between the first folding roller 23 and the second folding roller 24 in the conveying direction (S1106: Yes), the controller 100 stops the conveyance roller pair 22, the first folding roller 23, and the second folding roller 24, and ends the two-fold process.

Note that the controller 100 is not necessary to execute the three-fold process or the two-fold process on all the sheets S on which an image is formed by the image former 12. When the sheet S is ejected without being folded, the controller 100 may control the conveyance roller pair 22, the first folding roller 23, and the second folding roller 24 to perform the forward rotation in response to the sheet S supplied from the image former 12 through the input interface IN until the rear end of the sheet S passes through the clamping position between the first folding roller 23 and the second folding roller 24 in the conveying direction.

The control of the controller 100 that folds the sheet S on which an image is formed by the image former 12 by the sheet folding unit 20 and then delivers the sheet S to the sheet binding unit 30 is an example of "first control". On the other hand, the control of the controller 100 that delivers the sheet S on which an image is formed by the image former 12 to the sheet binding unit 30 without folding the sheet S by the sheet folding unit 20 is an example of "second control". Then, the controller 100 may switch between the first control and the second control on the basis of an instruction from the user through the operation panel 110 or an instruction from an external apparatus through the communication network.

Figure 13A:
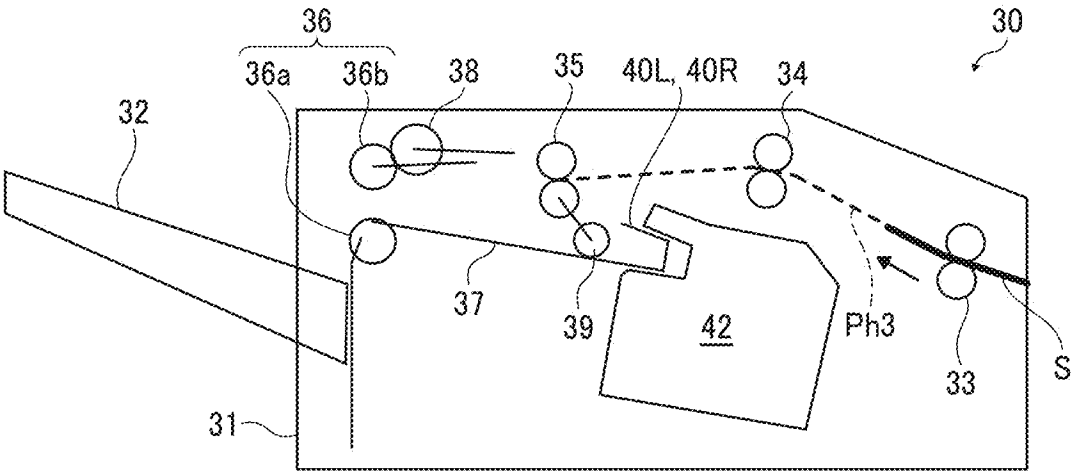
FIGS. 13A to 13B are views illustrating a state of the sheet binding unit until the sheet reaches a conveyance roller pair.
Figure 13B:
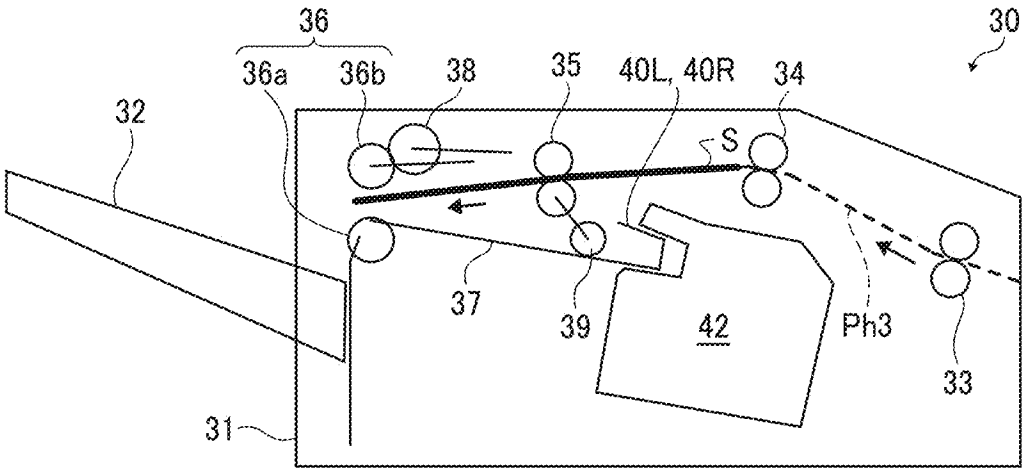
Figure 14A:
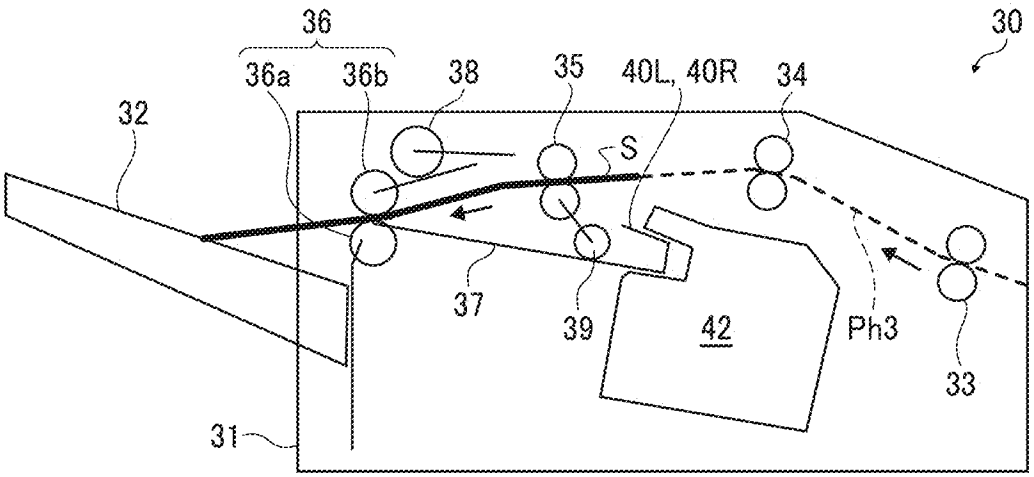
FIGS. 14A to 14B are views illustrating a state of the sheet binding unit in a case where the sheet is ejected to an ejection tray without performing a binding process.
Figure 14B:
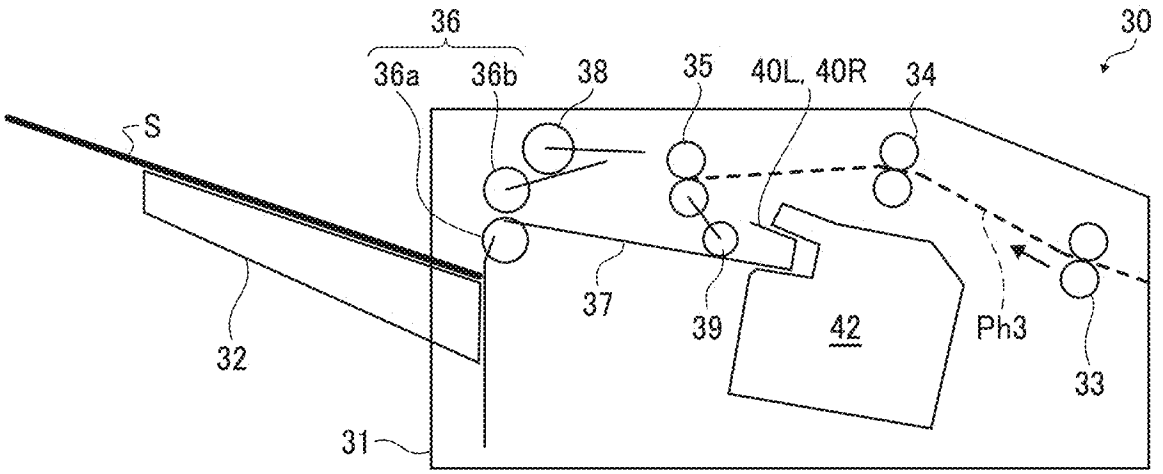
Figure 15A:
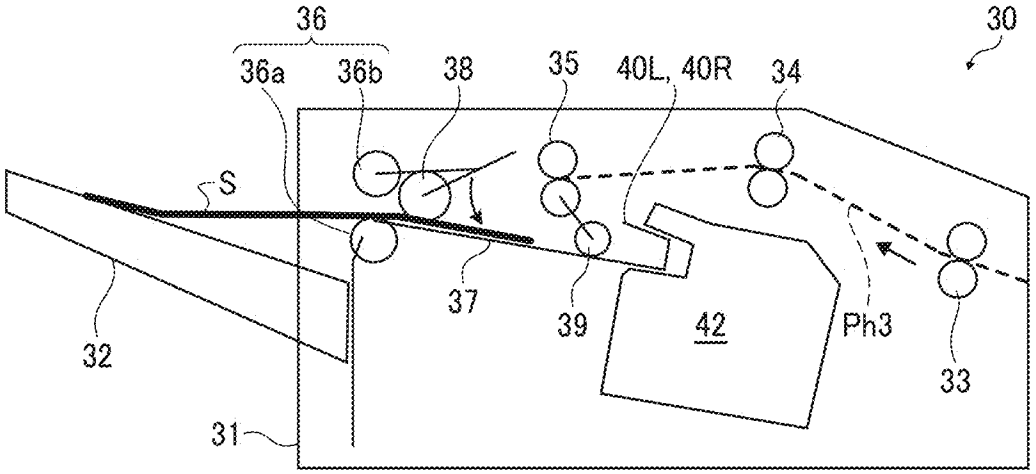
FIGS. 15A to 15B are views illustrating a state of the sheet binding unit that performs the binding process.
Figure 15B:
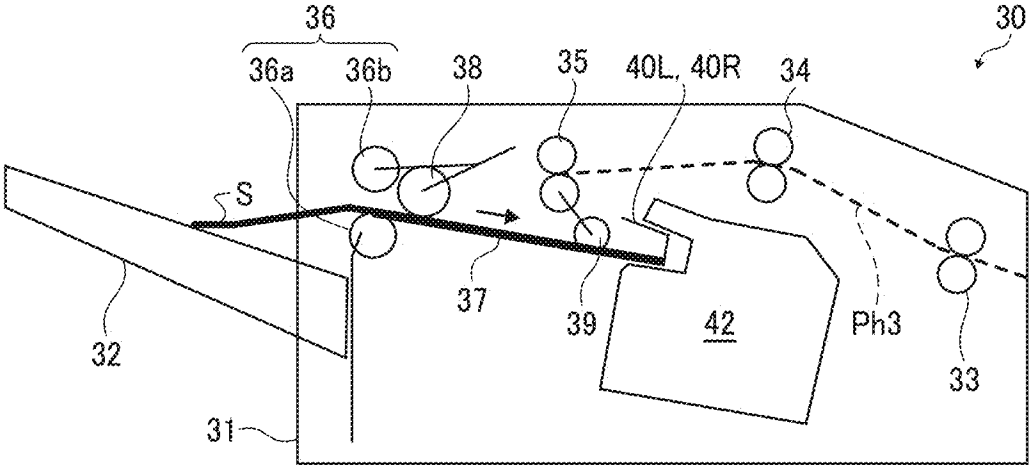
Figure 16:
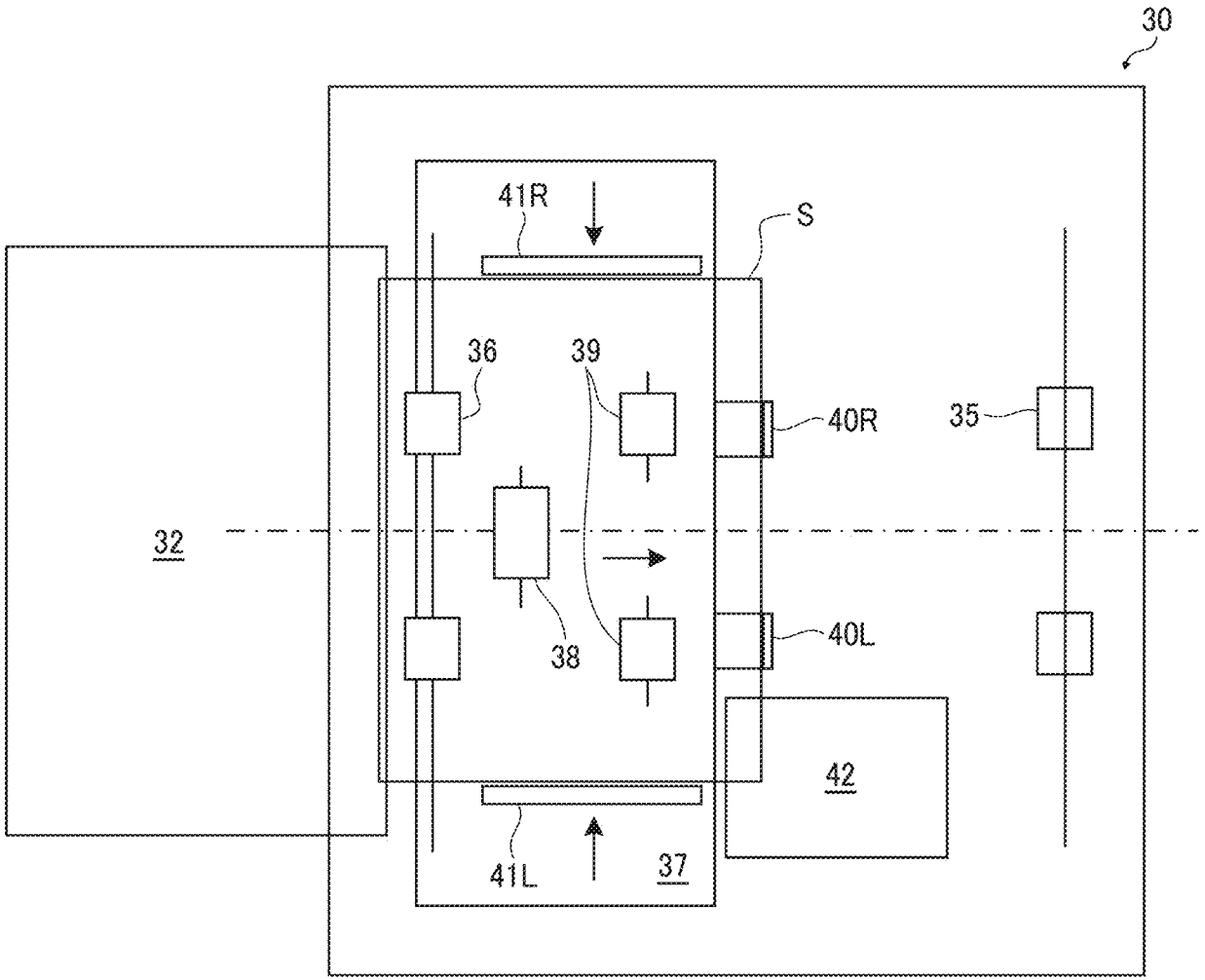
FIG. 16 is a view of the sheet binding unit in FIG. 15B as viewed from the thickness direction of the sheet.
Figure 17A:
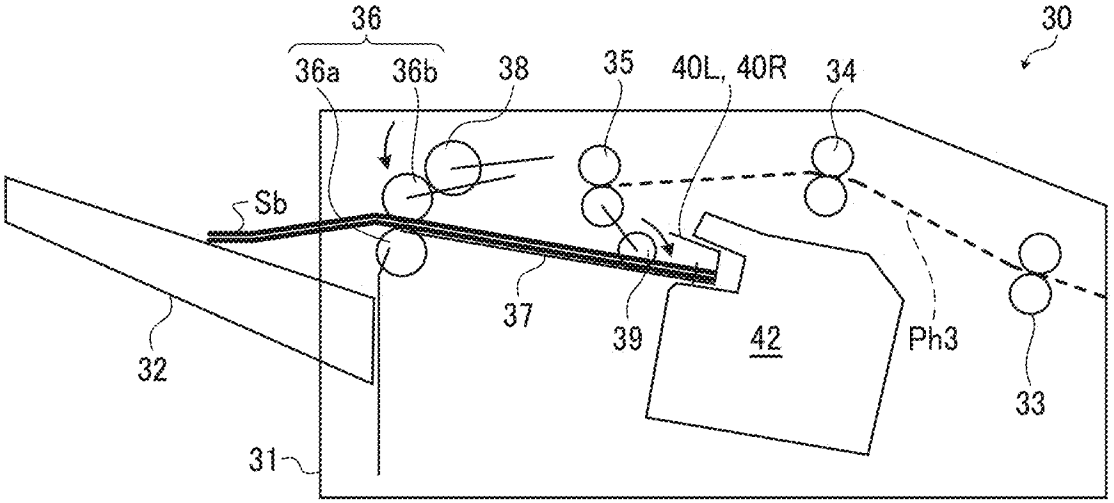
FIGS. 17A to 17B are views illustrating a state of the sheet binding unit in a case where a sheet bundle subjected to a binding process is ejected to the ejection tray.
Figure 17B:
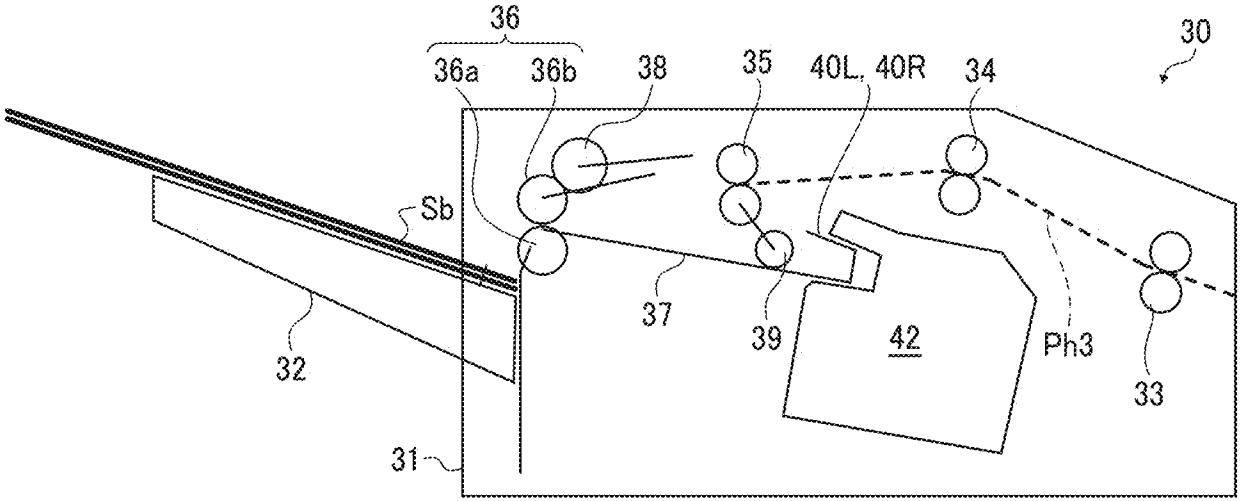

Next, an operation of the sheet binding unit 30 will be described with reference to FIGS. 13A to 17B. FIGS. 13A to 13B are views illustrating a state of the sheet binding unit until the sheet S reaches the conveyance roller pair 36. FIGS. 14A to 14B are views illustrating a state of the sheet binding unit 30 in a case where the sheet S is ejected to the ejection tray 32 without performing the binding process. FIGS. 15A to 15B are views illustrating a state of the sheet binding unit 30 that performs the binding process. FIG. 16 is a view of the sheet binding unit 30 in FIG. 15B as viewed from the thickness direction of the sheet S. FIGS. 17A to 17B are views illustrating a state of the sheet binding unit 30 when the sheet bundle Sb subjected to the binding process is ejected to the ejection tray 32.

First, as illustrated in FIGS. 13A to 13B, the sheet binding unit 30 causes the conveyance roller pairs 33 to 35 to perform the forward rotation to convey the sheet S supplied from the sheet folding unit 20 in the conveying direction along the conveying path Ph3. At this time, in the conveyance roller pair 36, the driving roller 36*a* and the driven roller 36*b* are separated from each other.

Next, in a case where the binding process is not performed on the sheet S, as illustrated in FIG. 14A, the sheet binding unit 30 causes the driving roller 36*a* and the driven roller 36*b* to clamp the sheet S. Then, as illustrated in FIG. 14B, the sheet binding unit 30 causes the conveyance roller pair 36 to perform the forward rotation to eject the sheet S to the ejection tray 32.

On the other hand, in a case where the binding process is performed on the sheet S, as illustrated in FIGS. 15A to 15B, the sheet binding unit 30 brings the tapping roller 38 and the return roller 39 to abut on the sheet S having passed through the conveyance roller pair 35 and rotates the tapping roller 38 and the return roller 39 to store the sheet S in the inner tray 37. As illustrated in FIG. 16, the sheet binding unit 30 moves the side fences 41L and 41R in the width direction to align the position in the width direction of the sheet S stored in the inner tray 37. Then, the sheet binding unit 30 repeats the process illustrated in FIGS. 13A to 13B, 15A to 15B, and 16 to form the sheet bundle Sb on the inner tray 37.

Next, the sheet binding unit 30 drives the binding processor 42 to bind the sheet bundle Sb supported by the inner tray 37. Next, as illustrated in FIG. 17A, the sheet binding unit 30 causes the driving roller 36*a* and the driven roller 36*b* to clamp the sheet bundle Sb. Then, as illustrated in FIG. 14B, the sheet binding unit 30 causes the conveyance roller pair 36 and the return roller 39 to perform the forward rotation to eject the sheet bundle Sb to the ejection tray 32.

According to the above-described embodiment, the following operational effects, for example, are achieved.

According to the above embodiment, various types of folding methods are implemented by combining the forward rotation and the backward rotation of three of the folding rollers 23, 24, and 25. By switching the posture of the guide plate 26, the sheet S can be appropriately conveyed in a desired direction. Furthermore, by rotating the second folding roller 24 and the guide plate 26 in conjunction with each other by the driving force transmission mechanism 28, a driving source for rotating the guide plate 26 can be omitted. As a result, the sheet folding unit 20 that can deal with various folding types with a simple configuration is implemented.

According to the above embodiment, by making the second rotation speed of the guide plate 26 larger than the first rotation speed of the second folding roller 24, the posture of the guide plate 26 can be quickly changed. As a result, an unintended behavior such as bending of the sheet S can be prevented, and the stability and accuracy of the folding process can be improved.

According to the above embodiment, the moving range of the guide plate 26 is limited by the stoppers 27*a* and 27*b*, and the torque limiter 28*a* is included in the driving force transmission mechanism 28, so that the second folding roller 24 and the guide plate 26 can be rotated in conjunction with each other with a simple configuration. Accordingly, the sheet folding unit 20 can be further downsized.

According to the above embodiment, the folding rollers 23 to 25, the guide plate 26, and the driving force transmission mechanism 28 are disposed on the opposite side with the partition wall 21*a* interposed therebetween, so that the sheet S can be prevented from being contaminated by dust emitted from the driving force transmission mechanism 28. Further, dust emitted from the sheet S can be prevented from clogging the driving force transmission mechanism 28 and inhibiting smooth transmission of the driving force.

Further, the sheet folding unit 20 according to the above embodiment has a particularly advantageous effect by being attached to the in-body space 13 of the image forming apparatus 10 having a limited space. However, what is attached to the in-body space 13 is not limited to the sheet folding unit 20. The attachment position of the sheet folding unit is not limited to the in-body space 13.

A first variation is described below.

Figure 18A:
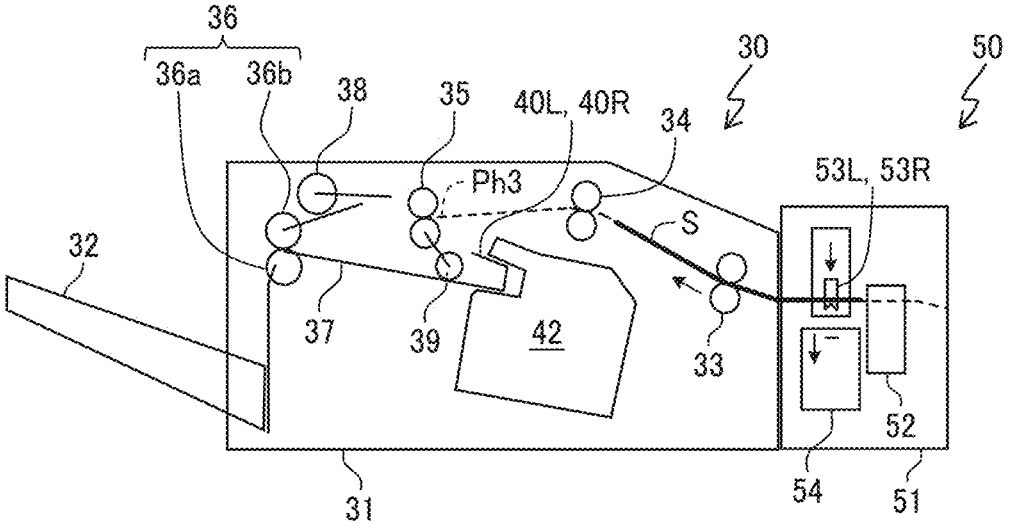
FIGS. 18A to 18B are diagrams illustrating an internal configuration of a hole punch unit.
Figure 18B:
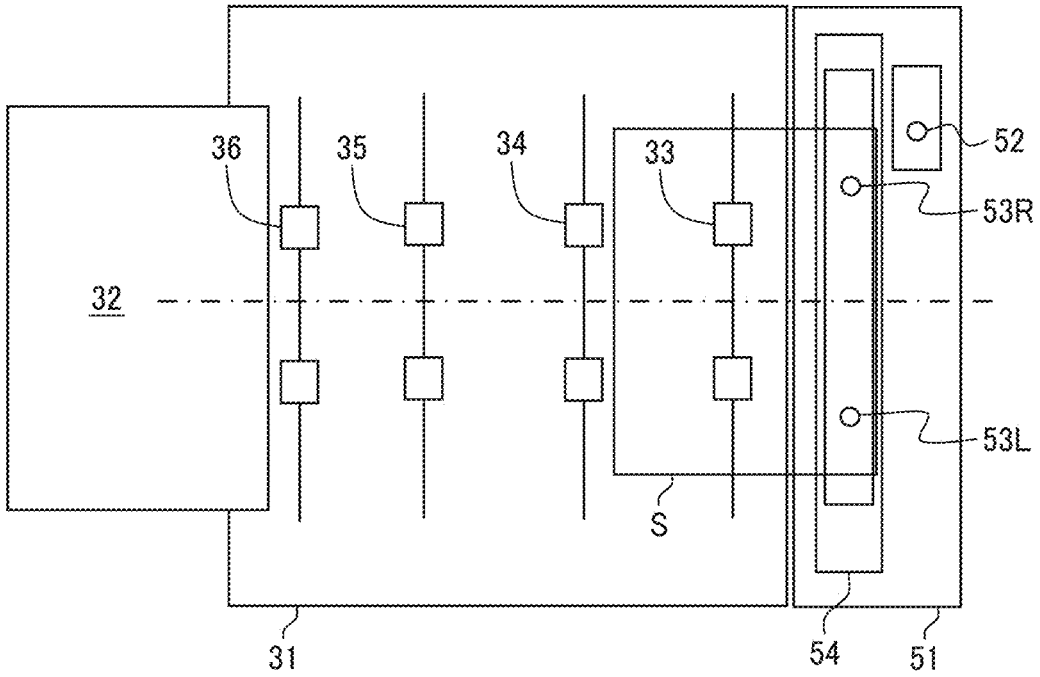

FIGS. 18A to 18B are diagrams illustrating an internal configuration of the hole punch unit 50 (serving as a hole punch). The hole punch unit 50 illustrated in FIGS. 18A to 18B is detachably attached to a position where the sheet folding unit 20 is removed in the in-body space 13. That is, the image forming apparatus 10 allows the sheet folding unit 20 and the hole punch unit 50 to be interchanged according to the application. Since the configuration of the hole punch unit 50 is already known, detailed description thereof is omitted, but for example, the following configuration may be adopted.

As illustrated in FIGS. 18A to 18B, the hole punch unit 50 includes a housing 51, a sheet sensor 52, punching pins 53*a* and 53*b*, and a punch waste hopper 54. The housing 51 includes an internal space for accommodating components of the hole punch unit 50. The internal space of the housing 51 has a conveyance path through which the sheet passes on which an image is formed by the image former 12. The sheet sensor 52 detects that the sheet S supplied from the image former 12 has reached a predetermined position. The punching pins 53*a* and 53*b* punch holes in the sheet S detected by the sheet sensor 52. Punch waste dropped from the sheet S falls into a punch waste hopper 54. As a result, a punching process of punching holes in the sheet S is implemented.

Next, a second variation is described below.

Figure 19:
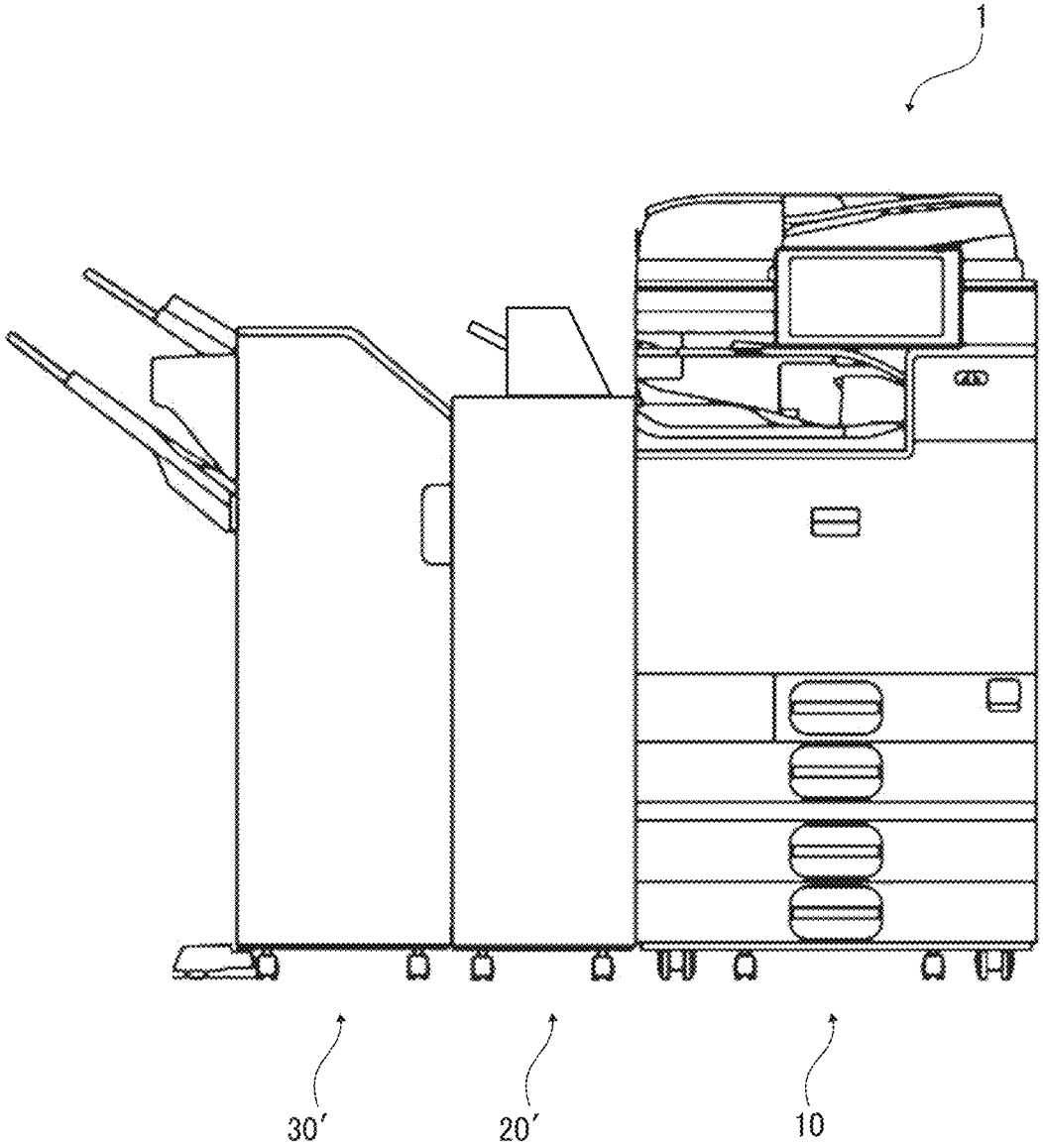
FIG. 19 is an external view of the image forming system.

FIG. 19 is an external view of the image forming system 1. As illustrated in FIG. 19, the image forming system 1 includes an image forming apparatus 10, a sheet folding apparatus 20', and a sheet binding apparatus 30'. The image forming apparatus 10, the sheet folding apparatus 20', and the sheet binding apparatus 30' are each independently operated and are mutually connected. Further, the configuration of the sheet folding apparatus 20' is common to the above-described sheet folding unit 20, and the configuration of the sheet binding apparatus 30' is common to the above-described sheet binding unit 30.

Note that the embodiments of the present disclosure are not limited to the above-described embodiments, and various modifications can be made without departing from the technical gist thereof, and all technical matters included in the technical idea described in the claims are the subject of the present invention. It is therefore to be understood that the above-described embodiments of the present disclosure may be practiced otherwise by those skilled in the art than as specifically described herein. Such embodiments and variations thereof are included in the scope and gist of the embodiments of the present disclosure and are included in the embodiments described in claims and the equivalent scope thereof.

Aspects of the present disclosure are, for example, as follows.

First Aspect

According to a first aspect, a sheet folding apparatus includes a conveyor, a first folding roller and a second folding roller, a third folding roller, a guide, a motor, and a driving force transmission mechanism. The conveyor conveys a sheet along a main conveying path in a conveying direction. The first folding roller and a second folding roller are disposed opposite to each other with the main conveying path interposed between the first folding roller and the second folding roller. The third folding roller is disposed opposite to the second folding roller with a reflux conveying path interposed between the third folding roller and the second folding roller. The reflux conveying path branches off from the main conveying path at a branching position upstream from the first folding roller in the conveying direction, and joins the main conveying path at a joining position upstream from the branching position in the conveying direction. The guide switches between a first posture and a second posture. The guide in the first posture prevents the sheet conveyed on the main conveying path in the conveying direction from entering the reflux conveying path through the branching position. The guide in the second posture allows the sheet to be conveyed from one of the main conveying path and the reflux conveying path to the other of the main conveying path and the reflux conveying path through the branching position. The motor causes the second folding roller to perform either forward rotation in which the second folding roller rotates to convey the sheet on the main conveying path in the conveying direction and to convey the sheet on the reflux conveying path from the joining position toward the branching position or backward rotation that the second folding roller rotates in a direction opposite to the forward rotation. The driving force transmission mechanism rotates the guide from the second posture toward the first posture in conjunction with the forward rotation of the second folding roller and rotates the guide from the first posture toward the second posture in conjunction with the backward rotation of the second folding roller.

Second Aspect

In the sheet folding apparatus according to the first aspect, the driving force transmission mechanism transmits a driving force of the motor to the guide such that the guide rotates at a rotation speed larger than a rotation speed of the second folding roller.

Third Aspect

The sheet folding apparatus according to the second aspect further includes a first stopper and a second stopper. The first stopper abuts on the guide in the first posture and prevents the guide from rotating in a direction away from the second posture. The second stopper abuts on the guide in the second posture and prevents the guide from rotating in a direction away from the first posture. The driving force transmission mechanism includes a torque limiter to release transmission of a driving force from the motor to the guide when the guide abuts on the first stopper or the second stopper and a rotational torque becomes equal to or larger than a threshold.

Fourth Aspect

The sheet folding apparatus according to the third aspect further includes a partition wall through which a rotation shaft of the second folding roller and a rotation shaft of the guide pass. The torque limiter is disposed on a side opposite to the second folding roller and the guide across the partition wall.

Fifth Aspect

The sheet folding apparatus according to any one of the first to fourth aspects further includes a controller to control rotation of the first folding roller, the second folding roller, and the third folding roller. The first folding roller performs forward rotation of conveying the sheet on the main conveying path in the conveying direction and performs backward rotation in which the first folding roller rotates in a direction opposite to the forward rotation. The third folding roller performs forward rotation of conveying the sheet on the reflux conveying path from the joining position toward the branching position and performs backward rotation in which the third folding roller rotates in a direction opposite to the forward rotation. The controller causes the first folding roller and the second folding roller to perform the forward rotation until a first folding position of the sheet reaches the branching position, causes the first folding roller, the second folding roller, and the third folding roller to perform the backward rotation at a timing when the first folding position reaches the branching position, until a distance from a clamping position between the first folding roller and the second folding roller to a front end of the sheet on the reflux conveying path and a distance from the clamping position to a second folding position upstream the first folding position in the conveying direction become equal; and causes the first folding roller, the second folding roller, and the third folding roller to perform the forward rotation at a timing when a distance from the clamping position to the front end of the sheet and a distance from the clamping position to the second folding position become equal, until a rear end of the sheet passes through the clamping position in the conveying direction.

Sixth Aspect

The sheet folding apparatus according to any one of the first to fourth aspects further includes a controller to control a rotation of the first folding roller, the second folding roller, and the third folding roller. The first folding roller performs forward rotation of conveying the sheet on the main conveying path in the conveying direction and performs backward rotation in which the first folding roller rotates in a direction opposite to the forward rotation. The third folding roller performs forward rotation of conveying the sheet on the reflux conveying path from the joining position toward the branching position and performs backward rotation in which the third folding roller rotates in a direction opposite to the forward rotation. The controller causes the first folding roller and the second folding roller to perform the forward rotation until a folding position of the sheet reaches the branching position; and causes the first folding roller, the second folding roller and the third folding roller to perform the backward rotation at a timing when the folding position of the sheet reaches the branching position, until a rear end of the sheet passes a clamping position between the second folding roller and the third folding roller.

Seventh Aspect

An image forming apparatus includes a housing, an image former, and the sheet folding apparatus according to any one of the first to sixth aspects. The image former is housed in the housing and forms an image on a sheet. The sheet folding apparatus is detachably supported by the housing, to fold the sheet on which the image is formed by the image former.

Eighth Aspect

The image forming apparatus according to the seventh aspect further includes a post-processing device. The post-processing device is supported by the housing and performs post-processing on the sheet on which an image is formed by the image former. The sheet folding apparatus is detachably attached to the housing at a position downstream from the image former and upstream from the post-processing device in a conveying path of the sheet from the image former to the post-processing device.

Ninth Aspect

In the image forming apparatus according the eighth aspect, the post-processing is a binding process of bundling and binding a plurality of sheets on which an image is formed by the image former.

Tenth Aspect

The image forming apparatus according to the eighth or ninth aspect further includes a controller to switch between a first control of folding the sheet on which the image is formed by the image former by the sheet folding apparatus and delivering the sheet folded to the post-processing device and a second control of delivering the sheet to the post-processing device without folding the sheet by the sheet folding apparatus.

Eleventh Aspect

The image forming apparatus according to any one of seventh to tenth aspects further includes a hole punch to punch a hole in the sheet on which the image is formed by the image former. The hole punch is detachably attached to a position at which the sheet folding apparatus is removed from the housing.

Twelfth Aspect

An image forming system includes an image forming apparatus to forms an image on a sheet and the sheet folding apparatus according to any one of the first to eighth aspects. The sheet folding apparatus is connected to the image forming apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet folding apparatus, comprising:

a conveyor to convey a sheet along a main conveying path in a conveying direction;

a first folding roller and a second folding roller disposed opposite to each other with the main conveying path interposed between the first folding roller and the second folding roller;

a third folding roller disposed opposite to the second folding roller with a reflux conveying path interposed between the third folding roller and the second folding roller, the reflux conveying path branching off from the main conveying path at a branching position upstream from the first folding roller in the conveying direction and joining the main conveying path at a joining position upstream from the branching position in the conveying direction;

a guide to switch between a first posture and a second posture, the guide in the first posture preventing the sheet conveyed on the main conveying path in the conveying direction from entering the reflux conveying path through the branching position, the guide in the second posture allowing the sheet to be conveyed from one of the main conveying path and the reflux conveying path to the other of the main conveying path and the reflux conveying path through the branching position;

a motor to cause the second folding roller to perform either forward rotation in which the second folding roller rotates to convey the sheet on the main conveying path in the conveying direction and to convey the sheet on the reflux conveying path from the joining position toward the branching position or backward rotation in which the second folding roller rotates in a direction opposite to the forward rotation; and a driving force transmission mechanism to rotate the guide from the second posture toward the first posture in conjunction with the forward rotation of the second folding roller and rotate the guide from the first posture toward the second posture in conjunction with the backward rotation of the second folding roller.

2. The sheet folding apparatus according to claim 1, wherein the driving force transmission mechanism transmits a driving force of the motor to the guide such that the guide rotates at a rotation speed larger than a rotation speed of the second folding roller.

3. The sheet folding apparatus according to claim 2, further comprising:

a first stopper to abut on the guide in the first posture and prevent the guide from rotating in a direction away from the second posture; and a second stopper to abut on the guide in the second posture and prevent the guide from rotating in a direction away from the first posture, wherein the driving force transmission mechanism includes a torque limiter to release transmission of a driving force from the motor to the guide when the guide abuts on the first stopper or the second stopper and a rotational torque becomes equal to or larger than a threshold.

4. The sheet folding apparatus according to claim 3, further comprising:

a partition wall through which a rotation shaft of the second folding roller and a rotation shaft of the guide pass, wherein the torque limiter is disposed on a side opposite to the second folding roller and the guide across the partition wall.

5. The sheet folding apparatus according to claim 1, further comprising:

a controller to control rotation of the first folding roller, the second folding roller, and the third folding roller, wherein the first folding roller performs forward rotation of conveying the sheet on the main conveying path in the conveying direction and performs backward rotation in which the first folding roller rotates in a direction opposite to the forward rotation, the third folding roller performs forward rotation of conveying the sheet on the reflux conveying path from the joining position toward the branching position and performs backward rotation in which the third folding roller rotates in a direction opposite to the forward rotation, and the controller causes the first folding roller and the second folding roller to perform the forward rotation until a first folding position of the sheet reaches the branching position, causes the first folding roller, the second folding roller, and the third folding roller to perform the backward rotation at a timing when the first folding position reaches the branching position, until a distance from a clamping position between the first folding roller and the second folding roller to a front end of the sheet on the reflux conveying path and a distance from the clamping position to a second folding position upstream from the first folding position in the conveying direction become equal, and causes the first folding roller, the second folding roller, and the third folding roller to perform the forward rotation at a timing when a distance from the clamping position to the front end of the sheet and a distance from the clamping position to the second folding position become equal, until a rear end of the sheet passes through the clamping position in the conveying direction.

6. The sheet folding apparatus according to claim 1, further comprising:

a controller to control rotation of the first folding roller, the second folding roller, and the third folding roller, wherein the first folding roller performs forward rotation of conveying the sheet on the main conveying path in the conveying direction and performs backward rotation in which the first folding roller rotates in a direction opposite to the forward rotation, the third folding roller performs forward rotation of conveying the sheet on the reflux conveying path from the joining position toward the branching position and performs backward rotation in which the third folding roller rotates in a direction opposite to the forward rotation, and the controller causes the first folding roller and the second folding roller to perform the forward rotation until a folding position of the sheet reaches the branching position, and causes the first folding roller, the second folding roller and the third folding roller to perform the backward rotation at a timing when the folding position of the sheet reaches the branching position, until a rear end of the sheet passes a clamping position between the second folding roller and the third folding roller.

7. An image forming apparatus, comprising:

a housing;

an image former housed in the housing to form an image on a sheet; and the sheet folding apparatus according to claim 1, wherein the sheet folding apparatus is detachably supported by the housing, to fold the sheet on which the image is formed by the image former.

8. The image forming apparatus according to claim 7, further comprising:

a post-processing device supported by the housing to perform post-processing on the sheet on which the image is formed by the image former, wherein the sheet folding apparatus is detachably attached to the housing at a position downstream from the image former and upstream from the post-processing device in a conveying path of the sheet from the image former to the post-processing device.

9. The image forming apparatus according to claim 8, wherein the post-processing is a binding process of bundling and binding a plurality of sheets on which an image is formed by the image former.

10. The image forming apparatus according to claim 8, further comprising a controller to switch between a first control of folding the sheet on which the image is formed by the image former by the sheet folding apparatus and delivering the sheet folded to the post-processing device and a second control of delivering the sheet to the post-processing device without folding the sheet by the sheet folding apparatus.

11. The image forming apparatus according to claim 7, further comprising a hole punch to punch a hole in the sheet on which the image is formed by the image former, wherein the hole punch is detachably attached to a position at which the sheet folding apparatus is removed from of the housing.

12. An image forming system comprising:

an image forming apparatus to form an image on a sheet; and the sheet folding apparatus according to claim 1 that is connected to the image forming apparatus.

* * * * *